US006468061B2

(12) United States Patent
Dyktynski et al.

(10) Patent No.: US 6,468,061 B2
(45) Date of Patent: Oct. 22, 2002

(54) ROTARY MACHINE

(75) Inventors: Benjamin Francis Dyktynski, Inglewood; Daryl Wheeler, Mt Helena; Lui Lau, Willetton, all of (AU)

(73) Assignee: Merlin Corporation Pty Ltd., Western Australia (AU)

( * ) Notice: Subject to any disclaimer, the term of this patent is extended or adjusted under 35 U.S.C. 154(b) by 0 days.

(21) Appl. No.: 09/906,220

(22) Filed: Jul. 16, 2001

(65) Prior Publication Data

US 2001/0046448 A1 Nov. 29, 2001

Related U.S. Application Data

(63) Continuation of application No. 09/269,387, filed as application No. PCT/AU97/00682 on Oct. 13, 1997, now Pat. No. 6,280,169.

(30) Foreign Application Priority Data

Oct. 11, 1996 (AU) ..... PO2924

(51) Int. Cl.[7] ..... F01C 1/356

(52) U.S. Cl. ..... 418/177; 418/187; 418/261

(58) Field of Search ..... 418/174, 177, 418/186, 187, 245, 249, 261

(56) References Cited

U.S. PATENT DOCUMENTS

| | | | | |
|---|---|---|---|---|
| 349,888 | A | 9/1886 | Knebel | |
| 355,479 | A | 1/1887 | Sleigh et al. | |
| 371,949 | A | 10/1887 | Knebel | |
| 389,328 | A | 9/1888 | Sleigh | |
| 398,988 | A | 5/1889 | Tickle | |
| 445,318 | A | 1/1891 | Leach | |
| 509,988 | A | 12/1893 | Williamson | |
| 590,581 | A | 9/1897 | Long | |
| 604,709 | A | 5/1898 | Cook | |
| 664,486 | A | 12/1900 | Lestrade | |
| 690,379 | A | 12/1901 | Sunderland | 418/177 |
| 866,677 | A | 9/1907 | Olson et al. | |
| 934,968 | A | 9/1909 | Harman | 418/177 |
| 987,264 | A | 3/1911 | Sivertson | 418/177 |
| 1,364,438 | A | 1/1921 | Johnson | 418/177 |
| 1,900,784 | A | 3/1933 | Zint | |
| 1,926,164 | A | 9/1933 | Morin et al. | 418/177 |
| 2,232,951 | A | 2/1941 | Kosian | |
| 2,507,151 | A | 5/1950 | Gabriel | 418/249 |
| 3,134,335 | A | 5/1964 | Jensen | |
| 3,241,456 | A | 3/1966 | Wolfe | 91/105 |
| 3,244,137 | A | 4/1966 | Garvey | 116/106 |
| 3,289,543 | A | 12/1966 | Wolfe | 91/71 |
| 3,426,694 | A | 2/1969 | Marsh | |
| 4,187,064 | A | 2/1980 | Wheeler | 418/187 |

FOREIGN PATENT DOCUMENTS

| | | | |
|---|---|---|---|
| AU | 3775568 | 11/1920 | |
| AU | 2254729 | 10/1930 | |
| AU | 2469848 | 1/1949 | |
| CA | 1061184 | 8/1979 | |
| DE | 679397 | 8/1939 | 418/187 |
| DE | 9115838 | 2/1992 | |
| FR | 978151 | 4/1951 | |
| FR | 1008880 | 5/1952 | |
| FR | 1241224 | 12/1960 | |
| GB | 1185371 | 3/1970 | |
| GB | 1246091 | 9/1971 | |

*Primary Examiner*—John J. Vrablik
(74) *Attorney, Agent, or Firm*—Ladas & Parry

(57) ABSTRACT

A rotary hydraulic machine (10) for incorporation in a drill string (92) of a well formation (86). The machine (10) is particularly adapted to act as a motor and includes an outer housing (11) of a generally cylindrical configuration having a radial inner surface (12). Rotatably mounted within the housing (11) is a shaft assembly (13) including a shaft (14) upon which a stator (15) is mounted. The stator (15) includes a plurality of lobes (16) which have a maximum radius approximately equal to the radius of the surface (12). A plurality of gates (35) are radially movably mounted in the housing (11) and engage the stator (15). The shaft (14) is hollow to provide for the delivery and the removal of hydraulic fluid to the working chambers (45 and 46) of the machine (10).

41 Claims, 19 Drawing Sheets

ROTARY MACHINE

This application is a continuation of application(s) application Ser. No. 09/269,387 filed on May 18, 1999, U.S. Pat. No. 6,280,169, which is International Application PCT/AU97/00682 filed on Oct. 13, 1997 and which designated the U.S., and was published in English, claims the benefit thereof and incorporates the same by reference.

TECHNICAL FIELD

The present invention relates to rotary pumps and motors, and more particularly but not exclusively to motors employed in well formations to drive the cutting head of a drill string.

BACKGROUND OF THE INVENTION

Disclosed in U.S. Pat. No. 4,187,064 is a rotary motor/pump which includes a central shaft surrounded by an outer housing. The shaft has an outer peripheral surface having at least one lobe while the other housing has a generally cylindrical inner surface in sliding contact or located adjacent the lobe. The outer housing is also provided with a plurality of radially movable gates. The gates co-operate with the lobe to provide variable volume working chambers which receive a working fluid under pressure when the device is acting as a motor or which exhausts a fluid under pressure when the device is acting as a pump or compressor. Relative rotation occurs between the shaft and the outer housing to vary the volume of the chambers.

Earlier rotary machines included steam engines such as those described in U.S. Pat. Nos. 349,888, 389,328, 664,486, 1,900,784, 371,949, 398,988, 500,988, 590,581, 355,479, 604,709 and 866,677. Although a variety of rotary motors are described their configuration is such that they are unemployable in a drill string of a well formation.

Fluid pumps and/or fluid motors are described in U.S. Pat. Nos. 2,232,951, 3,426,694, 445,318, 3,134,335 and 3,241,456. Again although a variety of rotary machines are described they are unemployable in a drill string.

An internal combustion engine is known having a rotor with an outer housing, with the rotor joined to the housing by means of radially reciprocated vanes. In one embodiment the vanes have rollers which engage a cam groove in the rotor. Again this device is unemployable in a drill string.

SUMMARY OF THE INVENTION

There is disclosed herein a rotary machine through which a working fluid passes, said machine comprising:

a central shaft means having a radially outer peripheral surface provided with at least one lobe having a maximum radius relative to the longitudinal axis of the shaft means;

an outer housing having an inner cylindrical surface surrounding the shaft means, the inner surface having a radius approximately equal to said maximum radius;

bearing means extending between the housing and shaft to provide for relative rotation therebetween;

a plurality of gates movably mounted in the housing for movement between a retracted position at least substantially located in said housing and an extended position protruding from said housing;

said gates, shaft and housing co-operating to define at least two variable volume working chambers, the volumes of which change with relative rotation between the shaft means and housing about said axis;

first duct means extending through said shaft and communicating with the chambers at a position adjacent to said lobe on a first angular side thereof;

second duct means extending through said shaft and communicating with said chambers adjacent said lobe on the other angular side thereof to the first duct means; and wherein relative rotation between said shaft means and housing provides for movement of said working fluid through said chambers via said first and second ducts.

In the rotary machine above, preferably the shaft means includes longitudinally extending fluid inlet and outlet passages forming part of said first and second duct means, said inlet passage extending to a plurality of inlet passage portions, and said outlet passage extending from a plurality of outlet passage portions, with the inlet passage portions and outlet passage portions being longitudinally co-extensive and with said inlet passage extending from a first end of said shaft and said outlet passage extending from an opposite end of said shaft to said first end.

In the above rotary machine, preferably said rotary machine is a motor, with said shaft means consisting of a shaft and a stator mounted thereon, said stator providing each lobe, said shaft having an outer diameter and an inner diameter according to the following formula:

$$D_m < D\{1-(2P\times10^{-7})/(ND^3)\}^{0.25}$$

where

P=power rating of the machine (Watts)

N=speed rating of the machine (rev/min)

D=shaft outside diameter (m)

Dm=shaft inside diameter

In the above rotary machine, preferably said outer housing has a wall thickness, and each lobe has a radial lobe height, with the wall thickness being such that:

$$W_t > 1.2L$$

where $W_t$=wall thickness of outer housing

L=lift of stator (height of lobes)

where $W_t$ is the wall thickness and L is the radial height of each lobe.

In the above rotary machine, preferably each shaft means includes a stator portion providing each lobe and having a radially outer surface, and each gate has a radially inner surface adjacent the radially outer surface of the stator, and a gate radial outer surface, with each gate further including a passage extending between the gate radially inner and radially outer surfaces.

In the above rotary machine, preferably the shaft means includes a stator providing each lobe, and the gates are of a "yoke" configuration so as to provide a base from which there radially inwardly extends a pair of generally parallel transversely spaced coextensive legs, and the stator includes cam means operatively associated with the legs to cause radial movement of the gates in coordination with movement of the gate relative to the lobes.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 1:
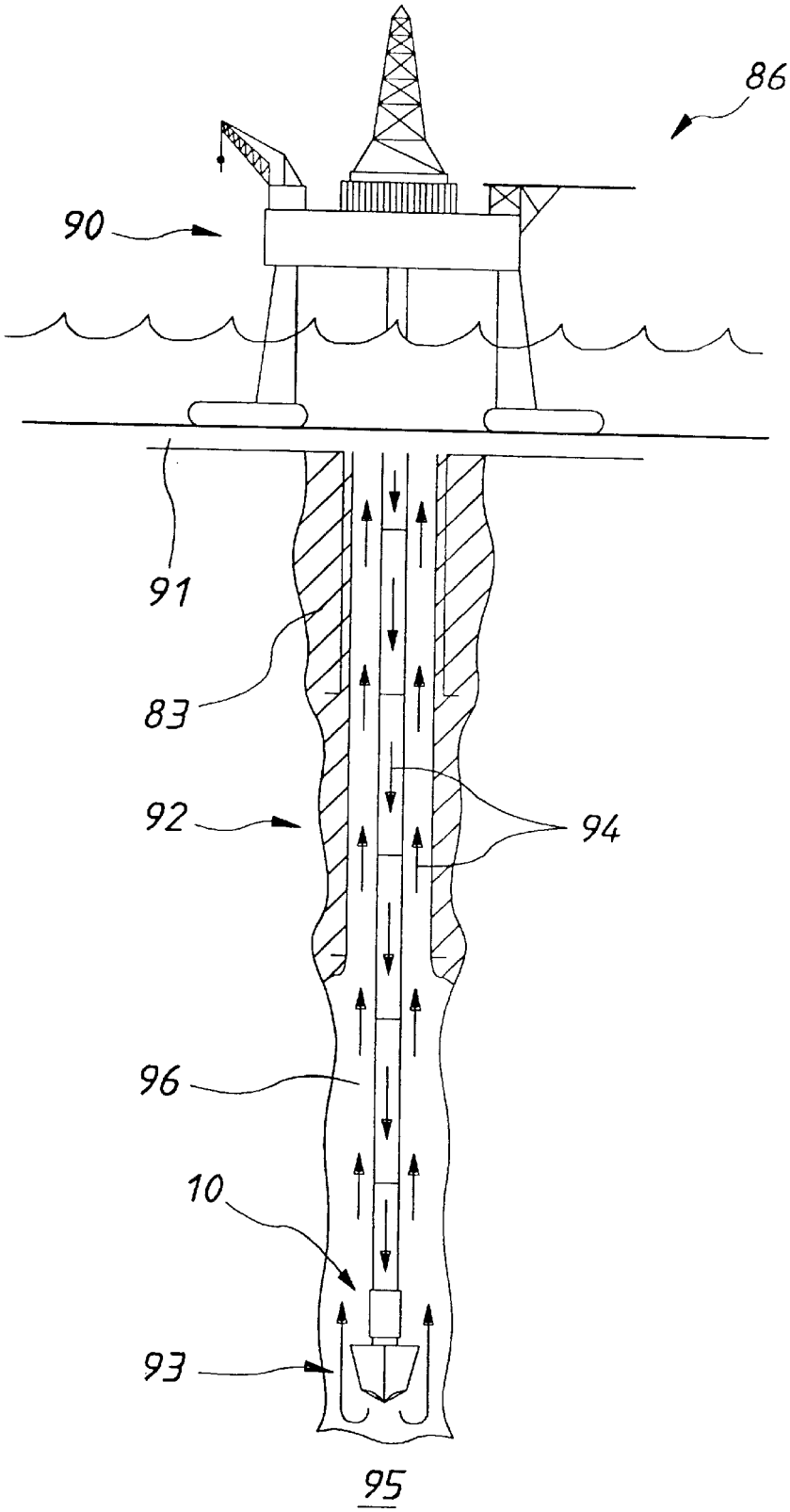
FIG. 1 is a schematic side elevation of a well formation including a drill string.
Figure 2:
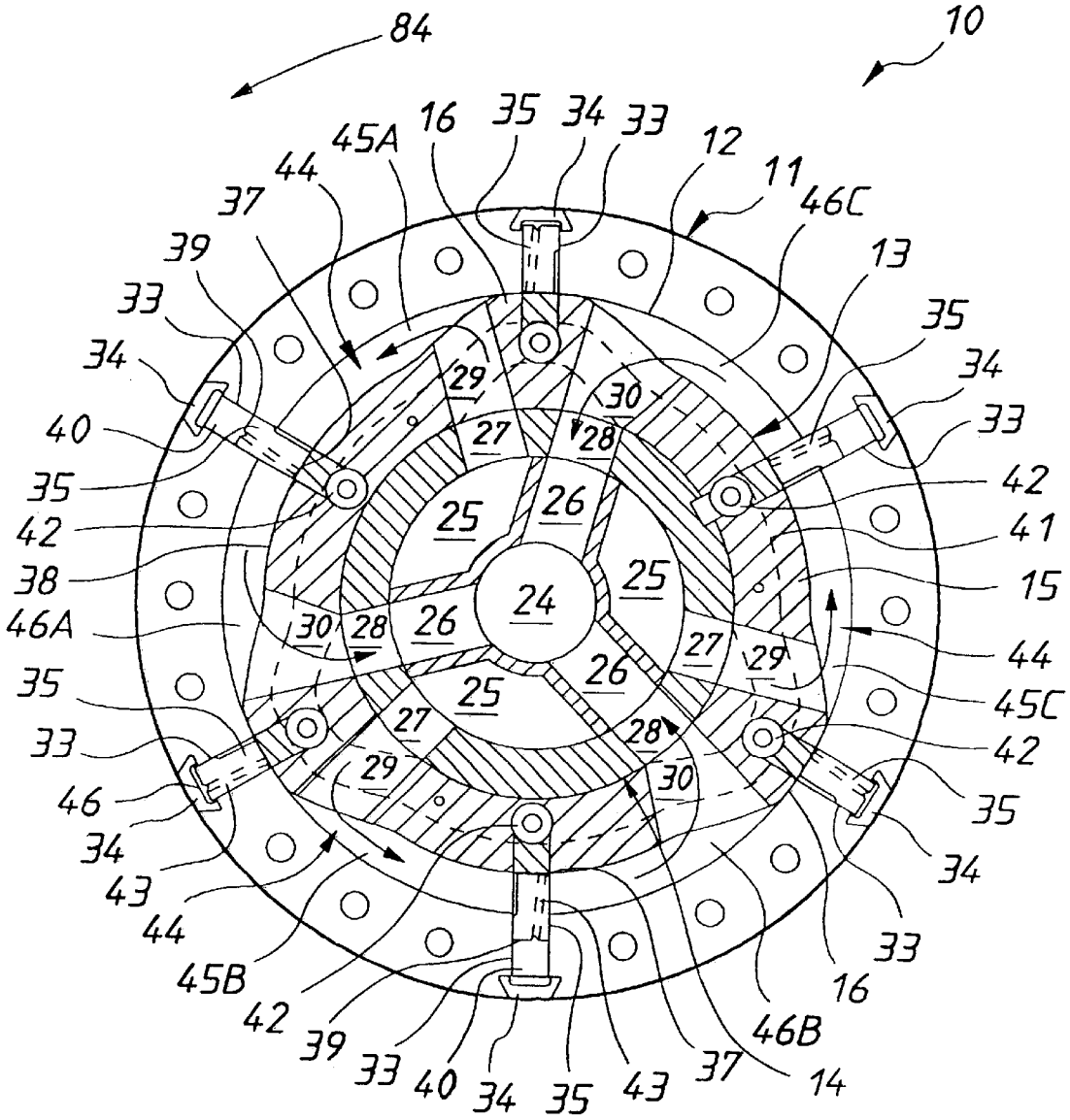
FIG. 2 is a schematic section elevation of a hydraulic motor.
Figure 3:
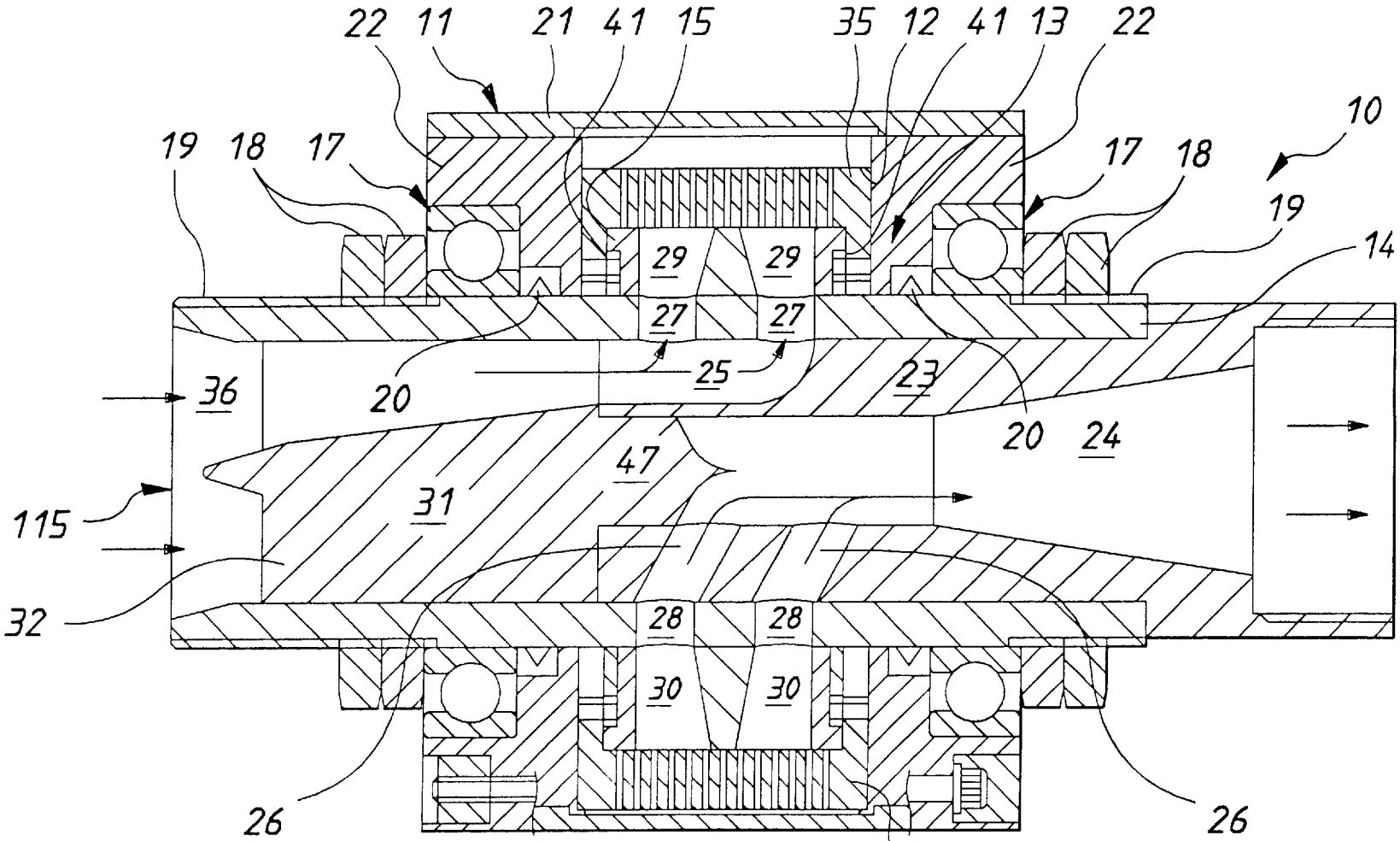
FIG. 3 is a schematic section side elevation of the motor of FIG. 2.
Figure 4:
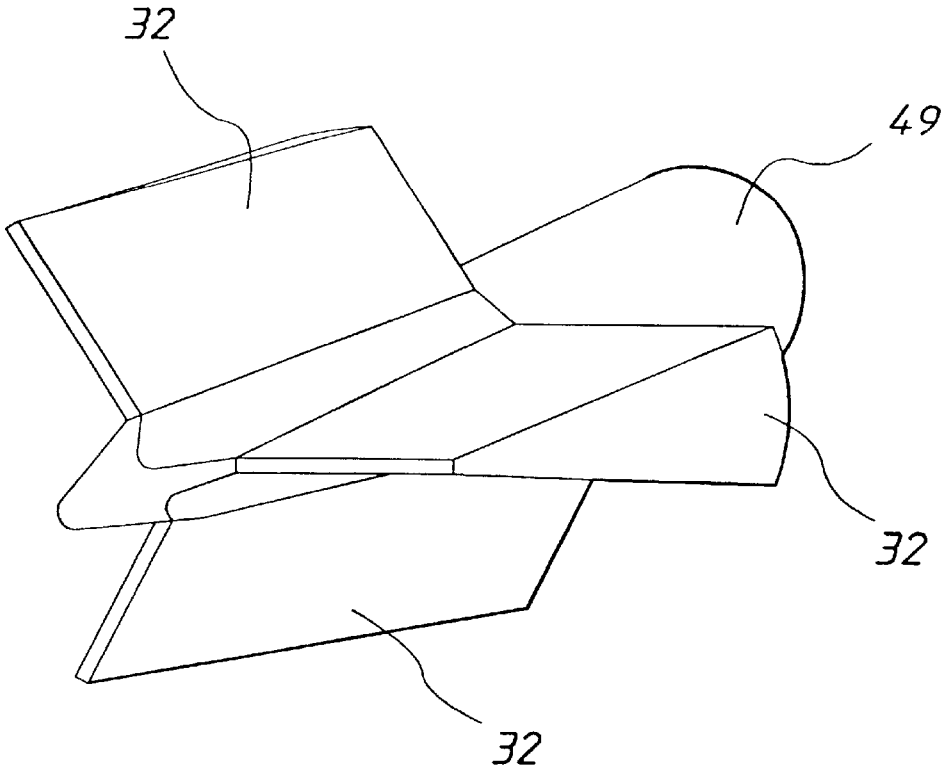
FIG. 4 is a schematic perspective view of a flow divider employed in the motor of FIG. 2.
Figure 5:
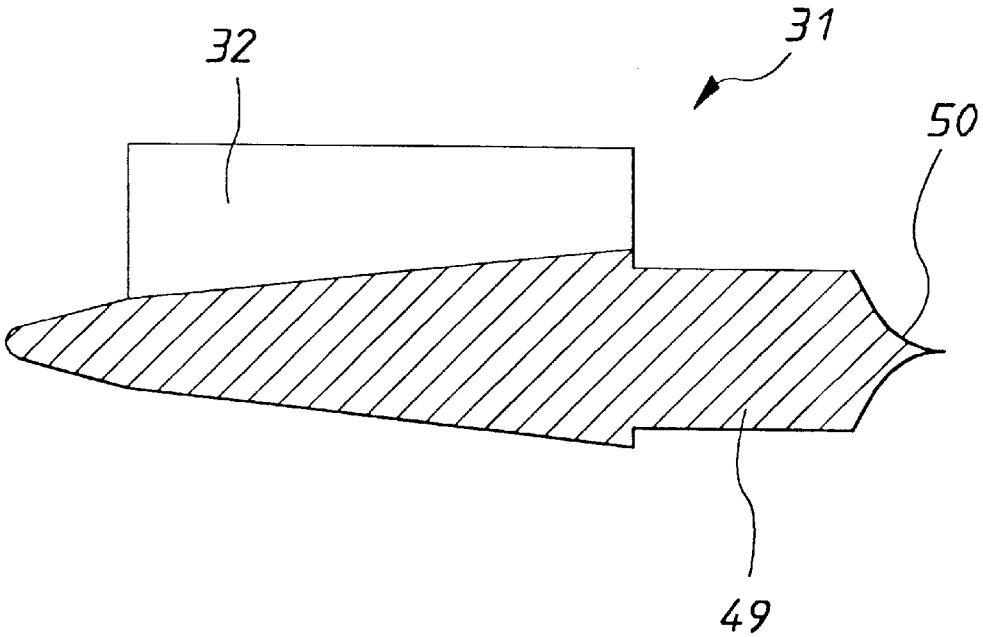
FIG. 5 is a schematic section side elevation of the flow divider of FIG. 4.
Figure 6:
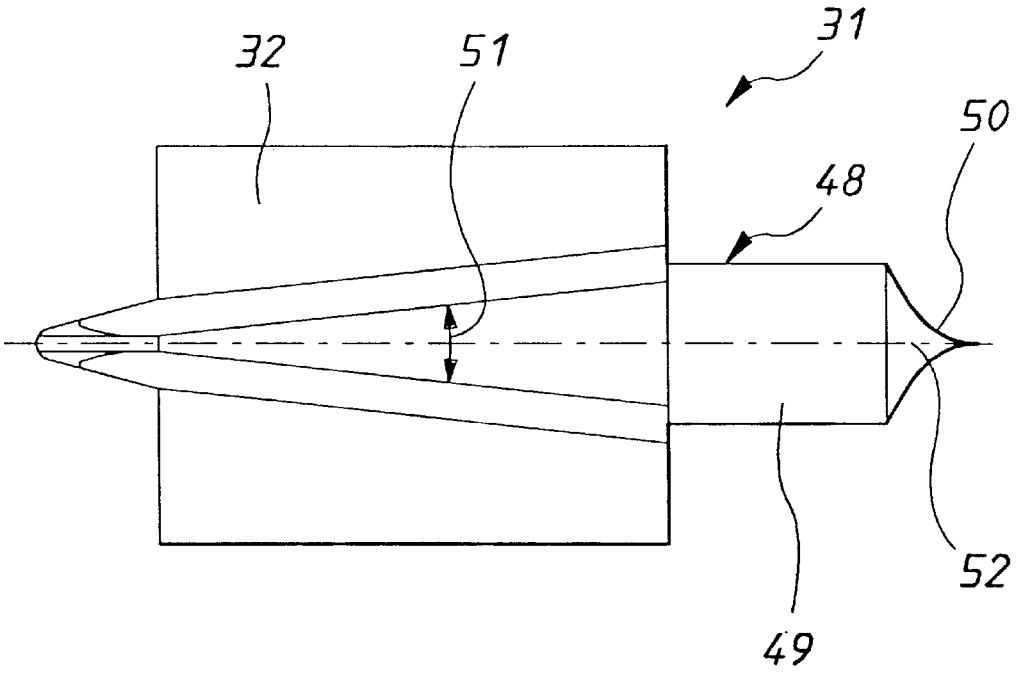
FIG. 6 is a schematic plan view of the flow divider of FIG. 4.
Figure 7:
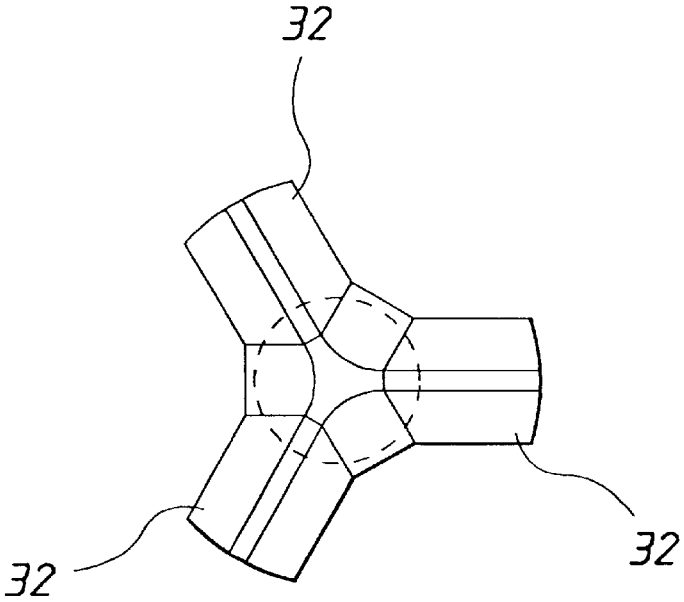
FIG. 7 is a schematic end elevation of the flow divider of FIG. 4.

In FIGS. 1 to 11 of the accompanying drawings there is schematically depicted a rotary machine 10. The machine 10 may act as a pump or motor, however in the present instance it will be described as a motor. Accordingly, a fluid under pressure is delivered to the machine 10. In FIG. 1 a drilling well formation 86 is illustrated. The formation 86 includes a rig 90 which in this embodiment rests on the seedbed 91. Extending from the rig is a drill string 92 having along its length a motor in the form of machine 10. The machine 10 drives a drilling head 93 or other drilling mechanisms. A hydraulic fluid (mud) 94 is pumped down through the string 92 to drive the machine 10 and cause rotation of the drilling head 93. Mud 94 under pressure also impacts against the soil formation 95 to aid in forming the hole 96 being drilled. A portion of the hole 96 is provided with a cement casing 83.

In the present embodiment the machine 10 includes an outer housing 11 having a generally cylindrical inner radial surface 12. The housing 11 surrounds a shaft assembly shaft 13 co-axial with respect to the longitudinal axis of the surface 12. In this embodiment, the shaft assembly 13 is stationery and the housing 11 rotates thereabouts. However, it should be appreciated that the reverse could take place.

The shaft assembly 13 includes a longitudinally extending shaft 14 to which there is affixed a stator 15. The stator 15 includes a plurality of lobes 16 which have a maximum radius approximately equal to the radius of the surface 12.

The housing 11 is rotatably supported on the shaft 14 by means of ball, roller or other bearings 17 secured in position by means of nuts 18. The nuts 18 threadably engage the threaded portions 19 of the shaft 14.

Extending between the housing 11 and the shaft 14 are seals 20.

The housing 11 includes an outer cylindrical portion 21 and two angular end plates 22 extending radially inwardly from the portion 21. The plates 22 extend to adjacent the shaft 14 so that the stator 15 is substantially enclosed by the portion 21, plates 22 and shaft 14.

The shaft 14 is substantially hollow and has mounted within it a duct defining member 23. The member 23 has a longitudinal passage 24 which in the present instance acts as an outlet passage. The member 23 also provides an inlet passage 115 divided to provide a plurality of inlet passage portions 25. Extending at least partly radially from the passage 24 are outlet passage portions 26.

The shaft 14 has radially extending passages 27 and 28 which communicate with passages 29 and 30 respectively, formed in the stator 15. The passages 27 and 28 are on angularly opposite sides of the associated lobe 16.

The shaft 14 also a longitudinally extending inlet passage 36 within which there is located a flow divider 31. The flow divider 31 includes a plurality of vanes 32 which aid in evenly dividing the flow and directing the flow to the passage portions 25.

The passage 110 extends from one end of the shaft 14 while the passage 24 extends from the opposite end.

The housing portion 21 is provided with a plurality of slots 33 which are closed by means of plugs 34. Mounted in each of the slots 33 is a radially movable gate 35. Each of the gates 35 is movable from a retracted position substantially located within the slot 33, and an extended position at which it extends a substantial distance from the slot 33 towards the stator 15.

With the machine 10 acting as a motor, machine 10 is driven in the direction of the arrow 84 by the differential in exposed length of the gate 35 to the high pressure passage 29, and the trailing gate 35 which is basically retracted. There is a resulting force which drives the housing portion 11 in the direction of the arrow 84. If the machine 10 is to act as a pump, the reverse operation takes place.

Each of the gates 35 has a radially inner end 37 which is located adjacent or is in sliding contact with the outer peripheral surface 38 of the stator 15. Defined between the radially outer end 39 and its associated plug 34 is a variable volume cavity 40.

The stator 15 is provided with a radially inwardly facing surface 41 which is engaged by a roller 42 attached to its gate 35.

Each gate is provided with one or more passages 43 extending between its inner end 37 and outer end 39. The passages 43 permit fluid to enter and leave the cavities 40 as the gates 35 radially reciprocate.

Enclosed by the stator 15, plates 22 and housing portion 11 are angularly extending cavities 44. Each cavity 44 extends between a pair of angularly adjacent lobes 16. The gates 35 co-operate therewith to subdivide each cavity 44 into two variable volume working chambers 45A, B and C and chambers 46A, B and C.

In operation of the above described machine 10 when operating as a motor, fluid under pressure is delivered to the inlet passage 36. Accordingly the fluid under pressure is delivered to the passages 29. The fluid under pressure enters the variable volume chambers 45A, B and C so that a force is applied to each of the gates 35 to cause rotation of the housing 11 relative to the shaft 14 in the direction of the arrow 84.

Each chamber 45 is a high pressure chamber until it progresses to a position exposed to one of the passages 30, at which time it becomes a low pressure chamber 46. For example, the chamber 45A is defined between an associated lobe 16 and gate 35. As the associated gate 35 approaches the passage 30, the next gate 35 will enter the cavity 44 blocking off the passage 29. The passage 30 is subsequently exposed and the chamber 45A will become a low pressure chamber 46A communicating with the passage 30 via which the fluid will exhaust to the outlet passage 46. In this regard it should be appreciated that the gates 35 co-operate so that there is no direct communication between the passages 29 and 30.

The machine 10, when operated as a motor, can be reversed by delivering the fluid under pressure to the passages 30 as opposed to the passages 29. In that instance, the passages 29 would then act as exhaust passages.

The housing portion 21 may actually consist of a plurality of segments between which the slots 33 are defined. The segments would be bolted to the side plates 22.

The flow divider 31, as best seen in FIGS. 4 to 7, includes a base 48 including a cylindrical projection 49 which is received within a correspondingly shaped portion of the passage 24. The projection 49 has a tapered end 50 which is generally conical although slightly arcuate. The arcuate tapered end 50 provides a smooth transition flow between the outer passage portions 26 and the passage 24.

The base 48 tapers from the projection 49 so that the angle 51 is approximately 14 degrees. The fins 32 are equally angularly spaced about the longitudinal axis 52.

The flow divider 31 enhances flow to the passages 47 by providing a smooth continuous path thereto. It also ensures that each of the cavities 44 receives a substantially equal flow.

Figure 8:
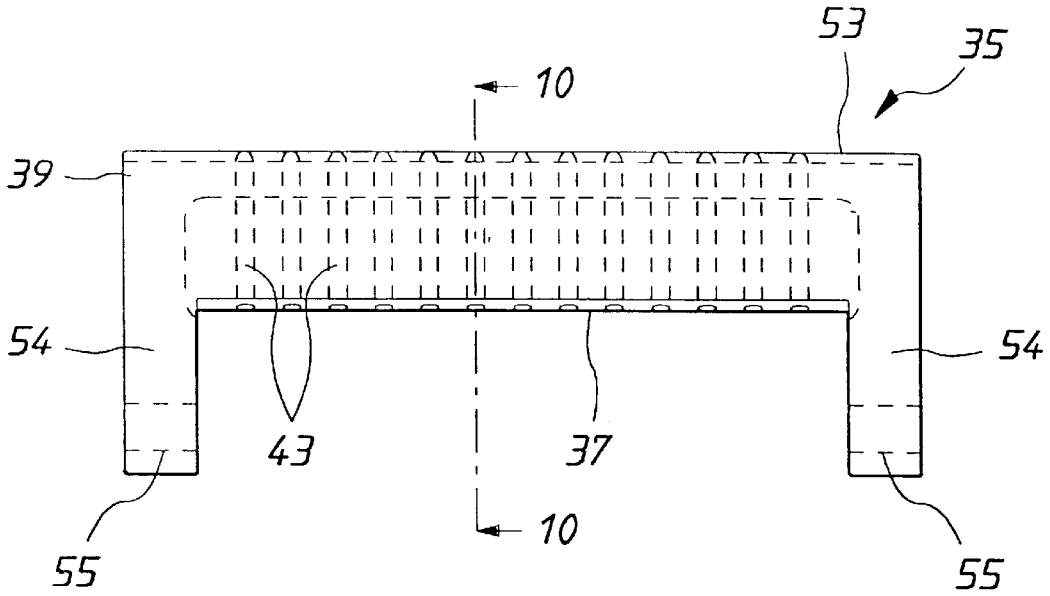
FIG. 8 is a schematic elevation of a gate employed in the motor of FIG. 2.
Figure 9:
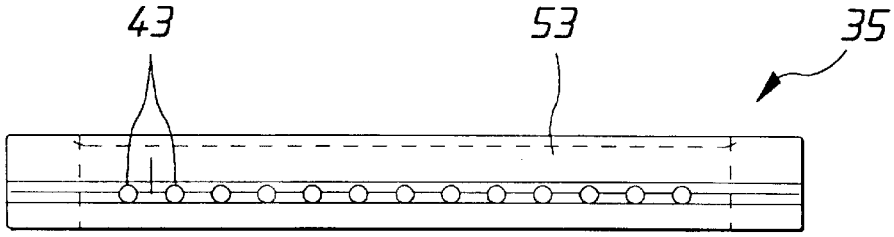
FIG. 9 is a schematic top plan view of the gate of FIG. 8.
Figure 10:
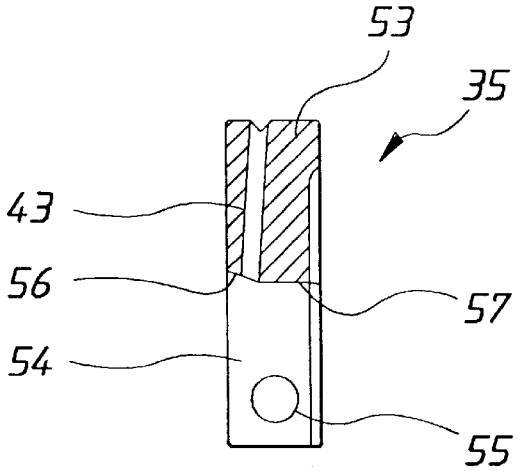
FIG. 10 is a schematic part sectioned end elevation of the gate of FIG. 8.
Figure 11:
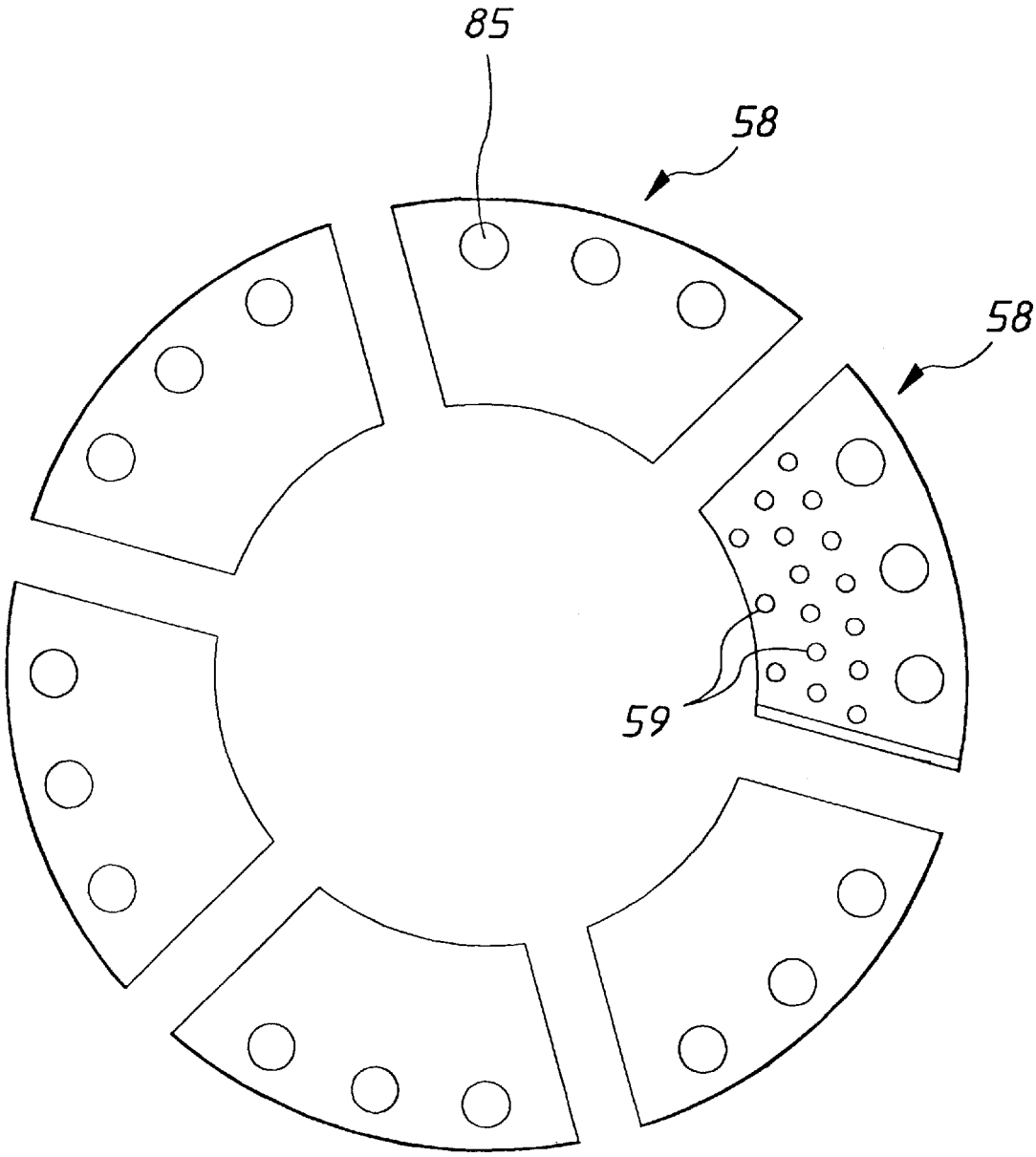
FIG. 11 is a schematic elevation of segments employed in the motor of FIG. 2.

In FIGS. 8 to 10, there is schematically depicted one of the gates 35. The gate 35 is of a "yoke" configuration having a base 53 from which there projects a pair of legs 54. Each of the legs 54 is provided with a passage 55 which receives an axle forming part of the roller 42. The axle would be rotatably received with the passage 55.

As best seen in FIG. 8, each gate 35 has a plurality of passages 43 which extend from the outer end 39 to the inner end 37. It should also be noted that the inner end 37 has a chamfered inner surface 56 to which the passages 43 extend, and a chamfered trailing surface 57. By having the passages 43 so arranged, a low pressure is delivered to each cavity 40 (relative to the pressures in the cavities 44, thereby applying a force radially outwardly to each of the gates 35). The gates 35 are then retained in position by the rollers 42. If the gates 35 were in a pump the passages 43 would extend to the trailing surface 57.

The surfaces 41 engaged by the rollers 42 could be part of a track along which the rollers 42 are constrained to move. In a modification of this, the rollers 42 could be replaced by pins which are received within correspondingly shaped slot extending angularly about the longitudinal axis of the machine 10.

In a still further modification (FIG. 11), an array of segments 58 could form part of the end plates 22. Two sets of segments 58 would be provided, with each set being located on a respective side of the gates 35. Still further, each set of segments 58 would be located on each side of the stator 15 and slidably engage the side surfaces thereof. The segments 58 are preferably each provided with a plurality of "dimples" 59 which aid sliding contact between the segments 58 and the stator 15. In essence, with reference to FIG. 3, the segments 58 would form part of the side plates 22. The segments would be provided with passages 85 through which fasteners would pass to secure the segments 58 to the two end plates 22.

In the above described embodiment, machine 10 has three lobes 16. In that respect it should be appreciated that the number of lobes 16 can be varied as required. More particularly, the machine 10 could have one or more lobes.

Figure 12:
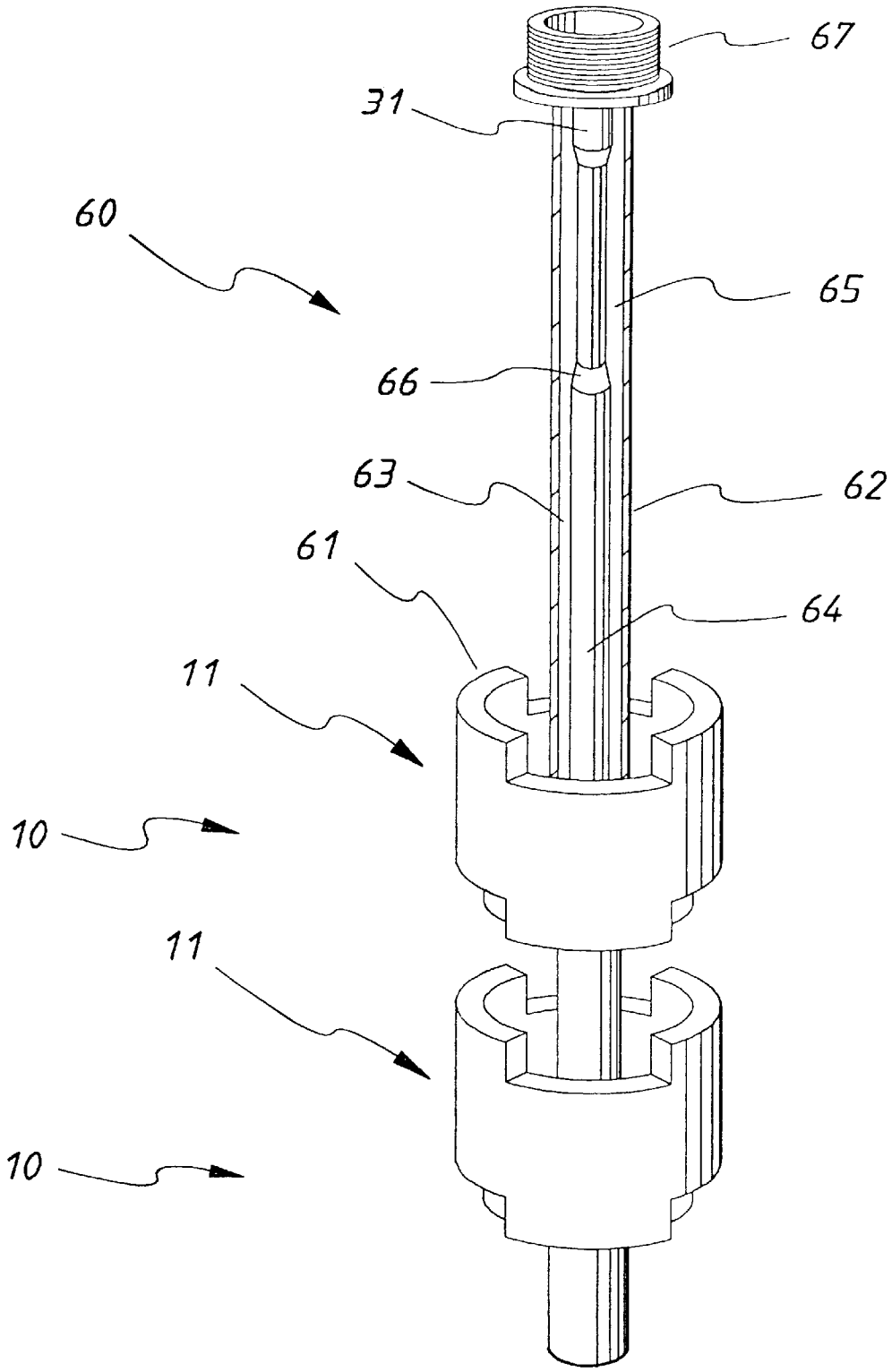
FIG. 12 is a schematic perspective view of a drilling apparatus, employing a plurality of the motors of FIG. 2.

In FIG. 12 there is schematically depicted a motor assembly 60 which consists of a stack of the machines 10. While FIG. 12 depicts a stack of machines 10, all having identical make-up in their sizes and arrangements, it should be emphasised that, the stator's 15 width, lobe 16 height and number of lobes 16 and hence number of gates 35 could be different in machine 10. In this embodiment, the machines 10 would be adapted so that the housings 11 had longitudinally extending castellations 61 which interlock so that the housings 11 rotated in unison. There is then a central shaft 62 upon which stator 15 of each machine 10 would be mounted. The shaft 62 would be hollow so as to have a longitudinally extending passage 63 which received an internal manifold member 64. The manifold member 64 again would be hollow. A longitudinally extending angular space 65 would be defined between the shaft 62 and manifold member 64. The space 65 would provide an inlet passage, while the passage defined internally of the manifold member 64 would provide an outlet passage. The manifold member 64 is gradually increased in diameter by means of steps or preferably tapers 66, so that the manifold member 64 increases in transverse cross section from the inlet flow divider 31 to the end machine 10. Preferably the manifold member 64 would be gradually increased in diameter to ensure that each successive machine 10 receives an equal flow or flow determined by the number and size of chambers 44.

The manifold member 64 would communicate with each of the machines 10 so as to receive exhaust flow therefrom.

As discussed earlier, the motor assembly 60 is intended to be part of a drilling apparatus, with the assembly 60 having a threaded end 67 which would extend to the ground surface or supporting apparatus. Fluid under pressure would be delivered to the space 65 to cause each machine 10 to operate and to cause rotation of the housings 11. The housings 11 would be attached to a down-hole drilling mechanism 93.

In the embodiment of FIG. 12, it should be particularly appreciated that the machines 10 are fed by inlet and exhaust passages which are substantially parallel and co-extensive.

In the above described preferred embodiments, the surface 38 engages the gates 35, preferably only when the gates 35 are being moved radially outwardly. The gates 35 are moved radially inwardly by use of the rollers 42 engaging the surfaces 41. This only occurs when there is not load or pressure on the gates 35.

The above described machine 10 may also act as a compressor or pump by having the housing 11 or shaft 14 driven.

In FIGS. 13 to 28 of the accompanying drawings there is schematically depicted a motor assembly 80. The motor assembly 80 consists of a pair of the machines 10 (10*a* and 10*b*) substantially as described above. In the present embodiment the reference numerals employed in FIGS. 1 to 11 have been used in FIGS. 13 to 28. However, the following modifications have been incorporated in the assembly 80.

Firstly, the machines 10*a* and 10*b* are constructed to allow limited drill mud to leak through its enclosed side plates 22. This limited leakage of drill mud has several important purposes. It cools and flushes the bearing 17 while allowing the mud pressure at the radial inner end of the gates 35 to be balanced with the mud pressure outside. This load is governed only by the mud operating pressure (differential) and is not influenced by the hydrostatic pressure to the position of the machine 10*a*. The load on the gates 35 is not effected by the hydrostatic pressure resulting from the well depth.

In a "down hole drilling" operation, the horizontal drilling operation is usually the final operational stage. By that time, there is always a constant column of drill mud or hydrostatic head acting on the machine 10. The pressure on the radial inner portions of the gates 35 are hydrostatically balanced to the column of mud. Still further to this, aeration of drill mud is virtually eliminated because the hydrostatic pressure is markedly larger than the partial pressure of the drill mud.

The machines 10*a* and 10*b* may be coupled so that the gates 35 of each machine are longitudinally aligned. This would require angular displacement of the lobes 16 of the machine 10*a* relative to the machine 10*b*.

As an alternative construction, the lobes 16 may be longitudinally aligned. This would then require the gates 35 of the machine 10*a* to be angularly displaced relative to the gates 35 of the machine 10*b*.

If more than two machines 10 are coupled, the lobes 16 or gates 35 would be arranged in a spiral manner about the longitudinal axis 89, or angularly offset to produce pulse free operation.

In this embodiment the adjacent end plates 22 of the two machines 10*a* and 10*b* are castellated so that two machines 10*a* and 10*b* rotate together. A small clearance is maintained between the two sets of castellations to provide for the flow of mud through the adjacent bearings. The nuts 18 which engage the threaded portions 19 maintain the machines 1O*a* and 10*b* coupled with the castellations engaged.

As assembly can often be difficult with respect to clearances between the stator 15 and end plates 22, the stator 15 is allowed to "float" longitudinally of the shaft 14. Any uneven wear as a result of contact between the stator 15 and end plates 22 is compensated by small movement of the stator 15. This small movement will allow self alignment of the stator 15 with respect to the end plates. In addition to this hydraulic balance must exist across the stator 15. This is achieved by permitting fluid flow between opposite end axial faces thereof in a passage 97

The confronting surfaces of the end plates 22 and stator 15 may be provided with small depressions (dimples) or cavities. These depressions act to separate the two confronting surfaces.

The area of the passages 76 at their radially outer limit is greater than 0.02 of the projected area of the radial outer extremity of the gate 35 (that is without the passages 76).

The machines 10*a* and 10*b* are provided with gate control rings which are each provided with an annular flange 70 which is located adjacent the radially inner extremities of the legs 54. The flanges 70 provide for a close clearance between the gates 35 and the stator 15. In that regard it should be appreciated that the rings 69 are attached to the end plates 22 so as to rotate therewith.

When the fluid is present and acting on the gates 35, the gates 35 are urged radially inward toward the stator 15. This results from the surface 91 having a different area than the total of the surfaces 77, 79, 80 and 81. Under this condition, the rollers 42 will not come in contact with the surface 41. The rollers 42 will be lifted over the lobes 16 by the surface 71 of the stator 15. Since the rollers 42 are separated from the surface 41 they move in one rotational direction. This ameliorates problems in respect of wear of the rollers 42 and their supporting structure.

In the above described preferred embodiment, as the leading gate 35 approaching the exhaust passage 30, the next (or trailing) gate 35 is already hydraulically locked onto the stator 15. The trailing gate 35 is supported by the flange 70 and effectively blocks off the inlet passage 29. The body of fluid confined within the corresponding gates 35 is the swept volume. When the gates 35 are in this arrangement, there are three bodies of fluid separated by them. The swept volume's fluid is separated from the exhaust fluid flowing to the passage 30 by the leading gate 35. The inlet fluid coming from the passage 29 is separated from the swept volume fluid by the trailing gate 35. Hence, the swept volume fluid is separated from the exhaust fluid and the inlet fluid by the leading and trailing gates 35 respectfully. The leading gate 35 will move over the passage 30 and prior to the transition point, it is hydraulically balanced.

A further modification of this embodiment is construction of the end plates 22 to be integrally formed with the segments 58 of the previous embodiment.

Figure 13:
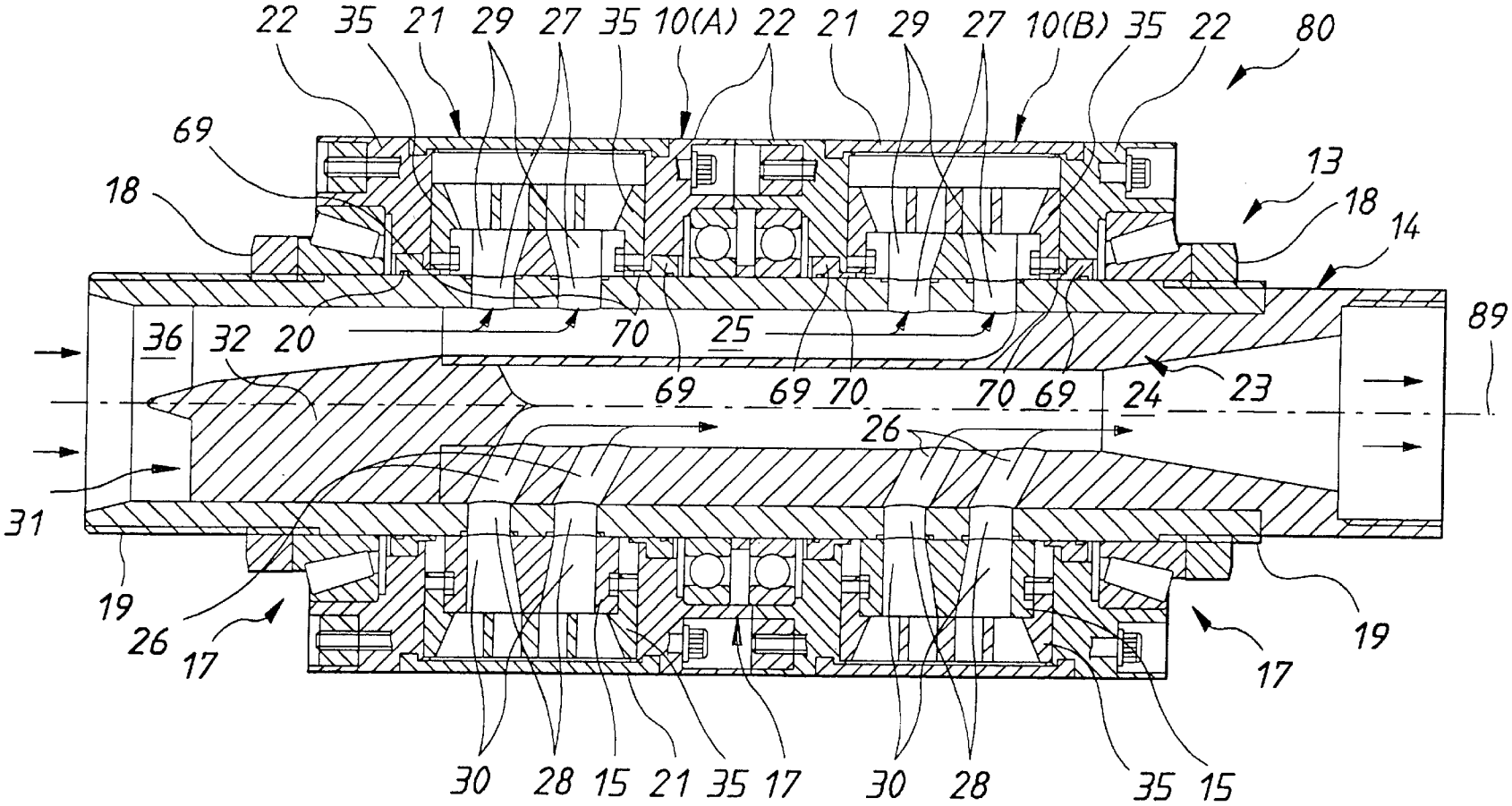
FIG. 13 is a schematic sectioned side elevation of a rotary motor which may be employed in the drill string of FIG. 1.
Figure 14:
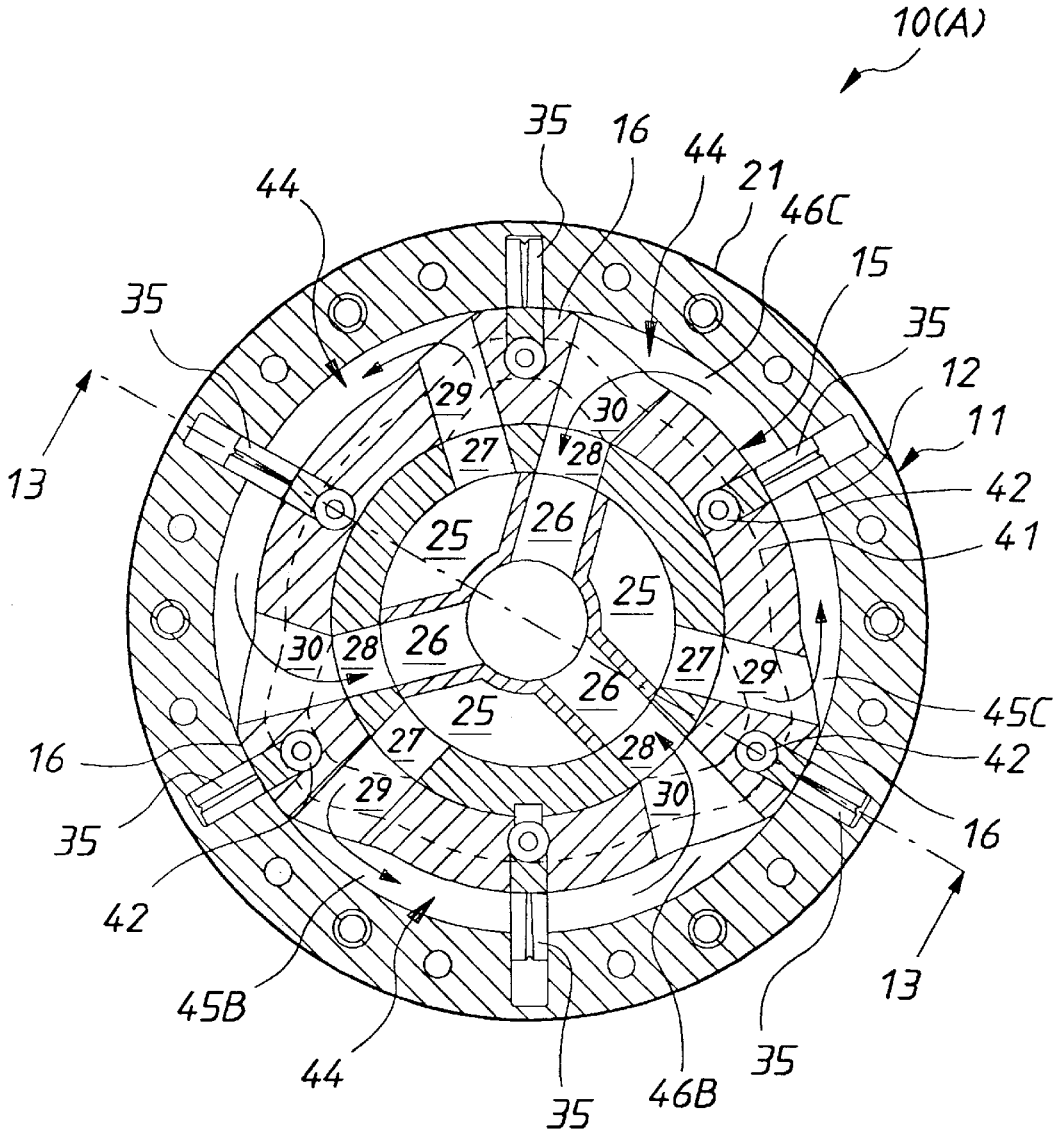
FIG. 14 is a schematic sectioned side elevation of the motor of FIG. 13.
Figure 16:
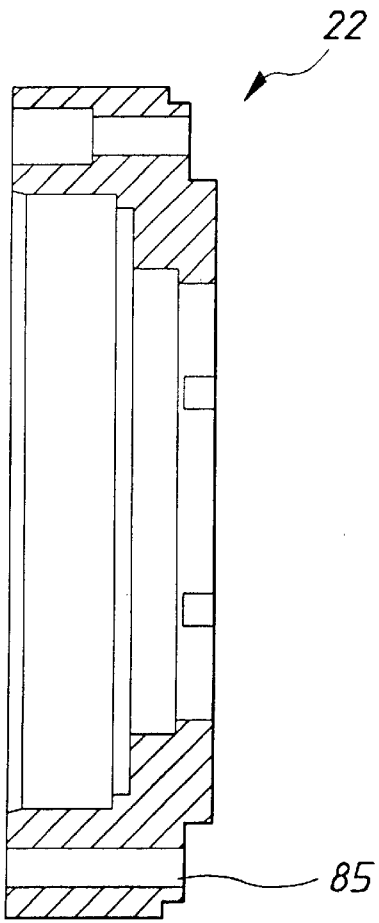
FIG. 16 is a schematic side elevation of the end plate of FIG. 15.
Figure 15:
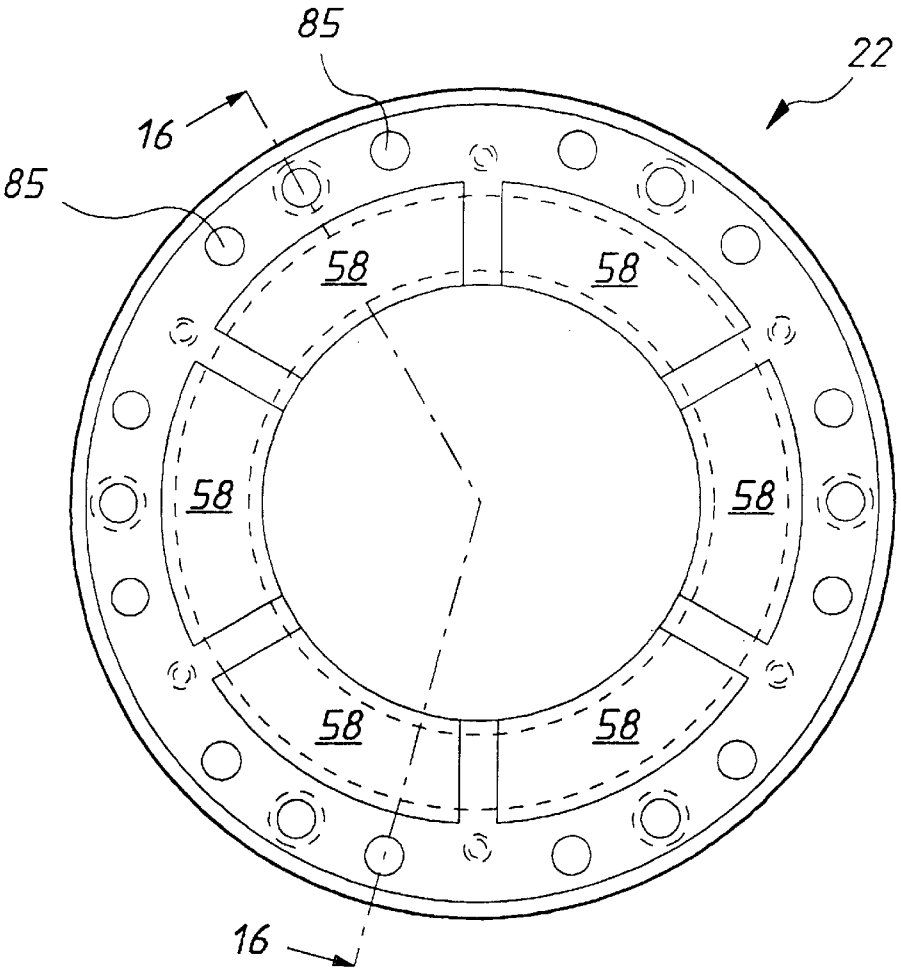
FIG. 15 is a schematic end elevation of an end plate employed in the motor of FIG. 13.
Figures 17, 20, 21:
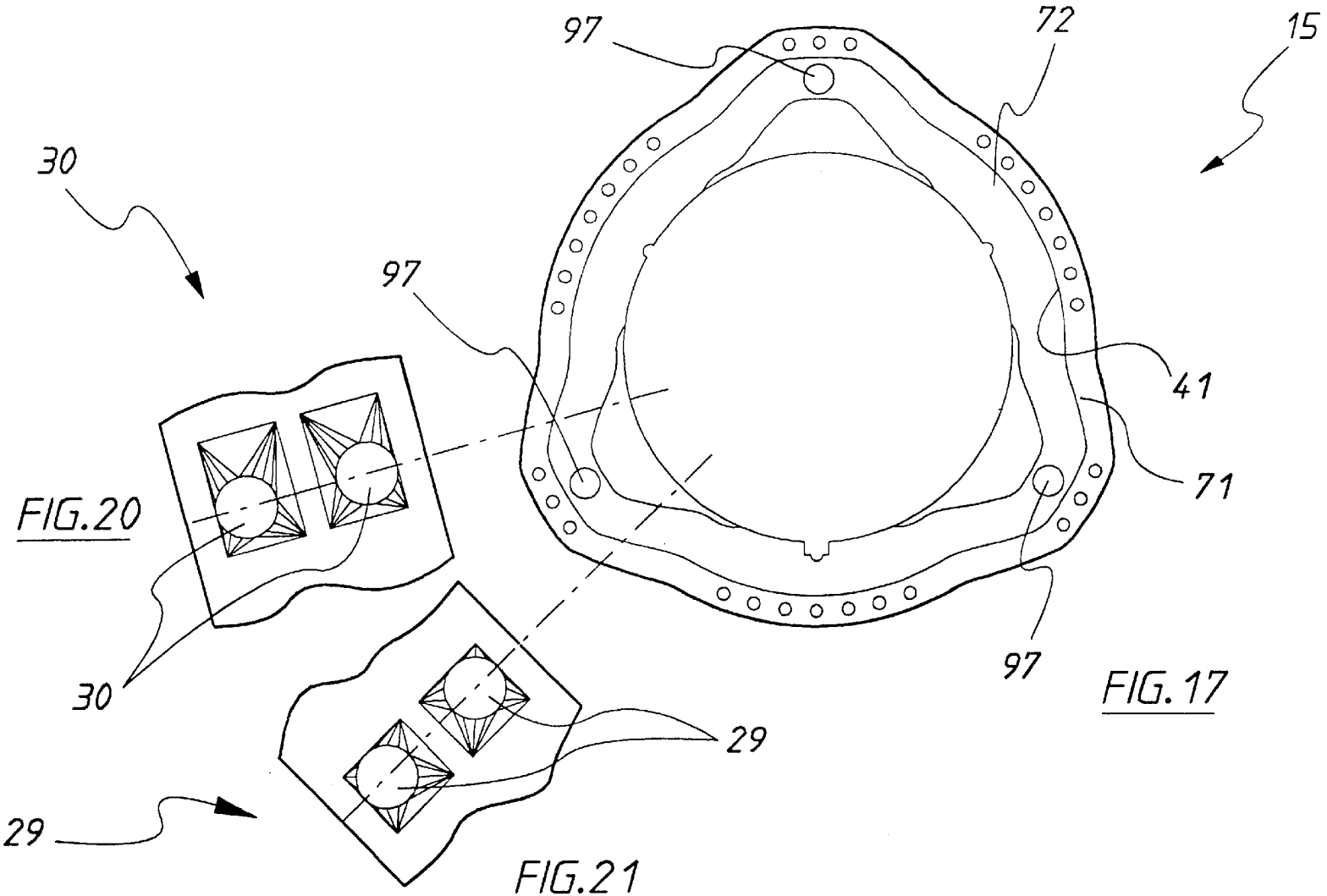
FIG. 17 is a schematic end elevation of a stator employed in the motor of FIG. 13.
FIG. 20 is a schematic plan view of outlet ports of the stator of FIG. 17.
FIG. 21 is a schematic plan view of inlet ports employed in the stator of FIG. 17.
Figure 18:
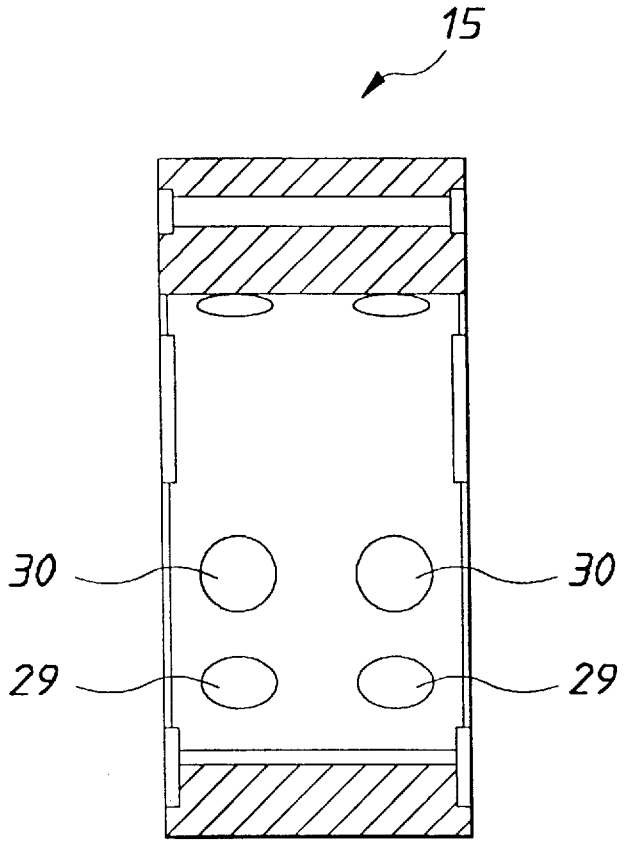
FIG. 18 is a schematic sectioned side elevation of the stator of FIG. 17.
Figure 19:
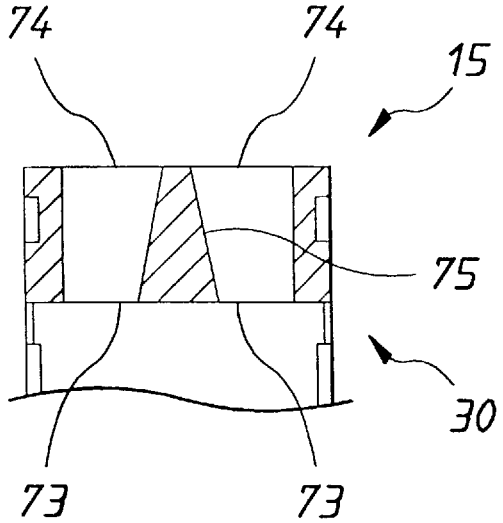
FIG. 19 is a schematic enlarged view of ports employed in the stator of FIG. 17.
Figure 22:
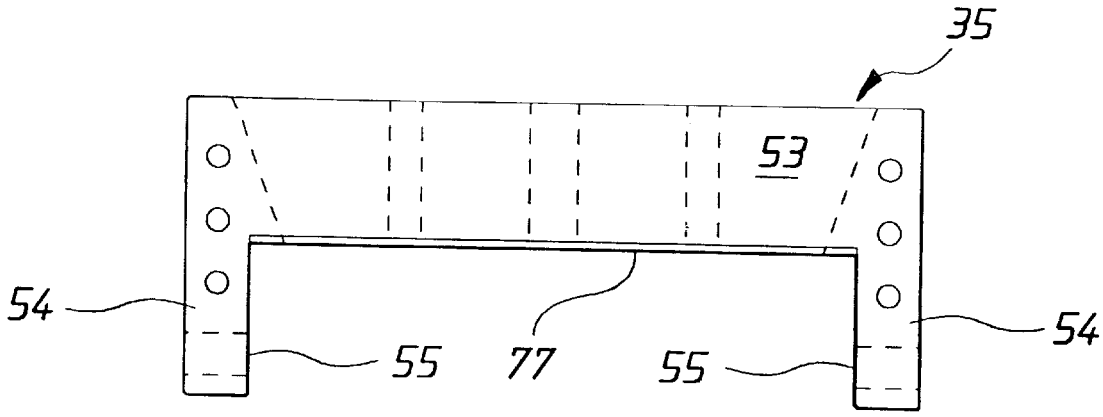
FIG. 22 is a schematic side elevation of a gate employed in the motor of FIG. 13.
Figure 23:
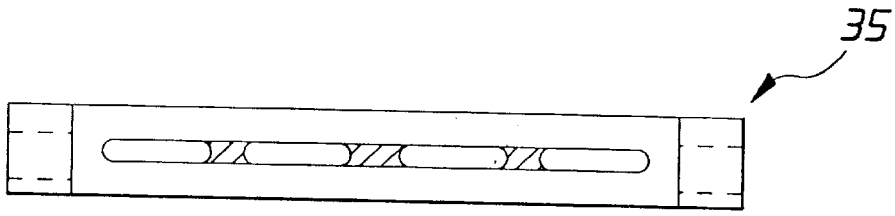
FIG. 23 is a schematic bottom plan view of the gate of FIG. 22.
Figure 24:
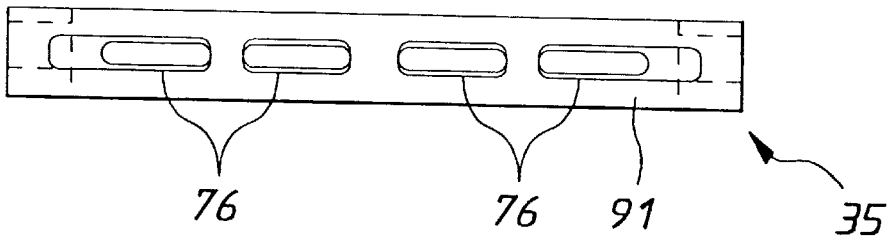
FIG. 24 is a schematic top plan view of the gate of FIG. 22.

In FIG. 17 there is schematically depicted the stator 15 of the embodiment of FIG. 13. The stator 15 is provided with the outlet ports 30 which are arranged in pairs. Similarly the stator 15 is provided with inlet ports 29 which are again arranged in pairs. The ports 29 and 30 taper from their radially outer extremities to their radially inner extremities as best seen in FIG. 19. Preferably, the radially inner apertures 73 are spaced by a greater distance than the radially outer passages 74 so that the ports 29 and 30 are separated by a web 75 which increases in transverse width radially inwardly.

Figure 25:
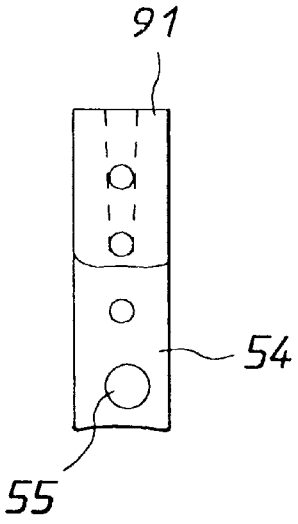
FIG. 25 is a schematic end elevation of the gate of FIG. 22.
Figure 26:
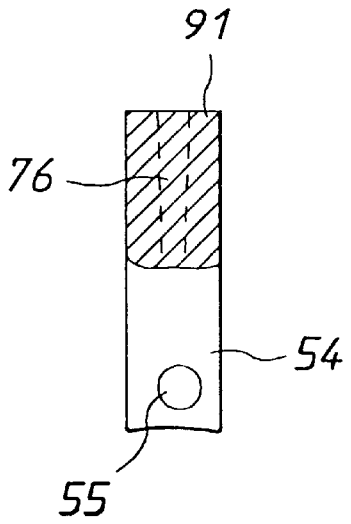
FIG. 26 is a schematic part sectioned end elevation of the gate of FIG. 22.
Figure 27:
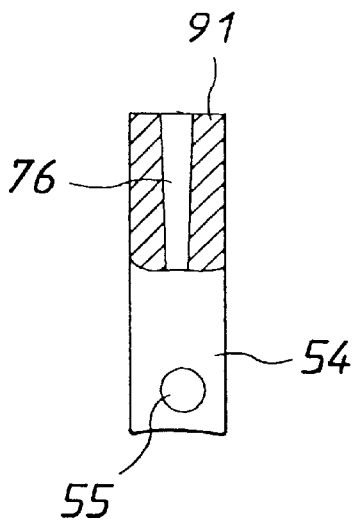
FIG. 27 is a further schematic end elevation of the gate of FIG. 22.

In this embodiment the gates 35 are also of a "yoke" configuration however, they are provided with slots 76 as opposed to the circular passages 43 of the previous embodiment. The slots terminate at the radially inner arcuate surface 77 of the base 53. The slots 76 taper radially inwardly as best seen in FIGS. 25 to 27. This ameliorates the problem of cavitation by allowing grater flow rate with a lower velocity. This enables the machines 10 to operate at higher speeds.

Figure 28:
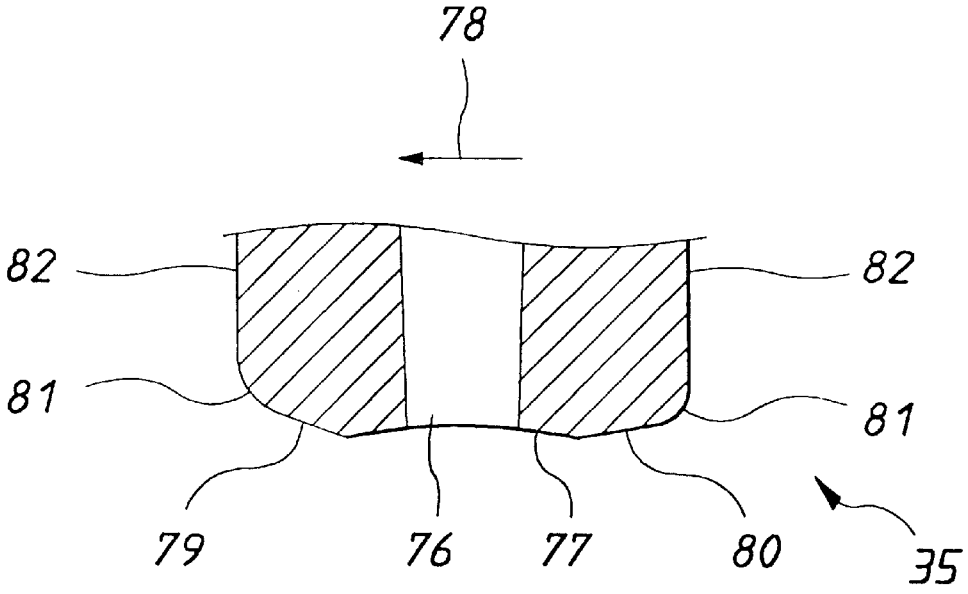
FIG. 28 is a schematic enlarged view of a portion of the gate of FIG. 22.

The gates 35 are intended to move relative to the stator 15 in the direction of the arrow 78 (FIG. 28). The surface 77 leads to trailing and leading chamfered surfaces 79 and 80, with the surface 79 being inclined by approximately 19° while the surface 80 is inclined by approximately 9.5°. Both surfaces 79 and 80 lead to arcuate portions 81 which lead to the side surfaces 82 of the legs 54. These angles are determined by the configurations of the lobes 16.

Surface 77 is the sealing face which limits the leakage flow transversely across the gate. It has a substantially conforming curve with the surface 103 of the stator 15. Surfaces 80–81 are exposed to the high pressure fluid while surfaces 79 and 81 are exposed to the low pressure fluid. The passages 76 substantially balance the pressure at surface 77 and the pressure acting on the radially opposing surface. The areas of the said surfaces and the various pressures they are exposed to yields a resultant force whose magnitude and direction are limited and controlled. In this case the force is of a small magnitude acting radially inward towards the axis 89. This force is resisted by the flange 70.

Preferably, each lobe 16 has a rise portion extending angularly over the associated passage 30 that is greater than the angle of the fall portion extending over the associate passage 29. However, in some instances the rise and fall angles can be equal.

Preferably, the area of each passage 30 at its radially outer extremity is greater than the area each of the ports 29 at their radially outer extremity.

Figure 29:
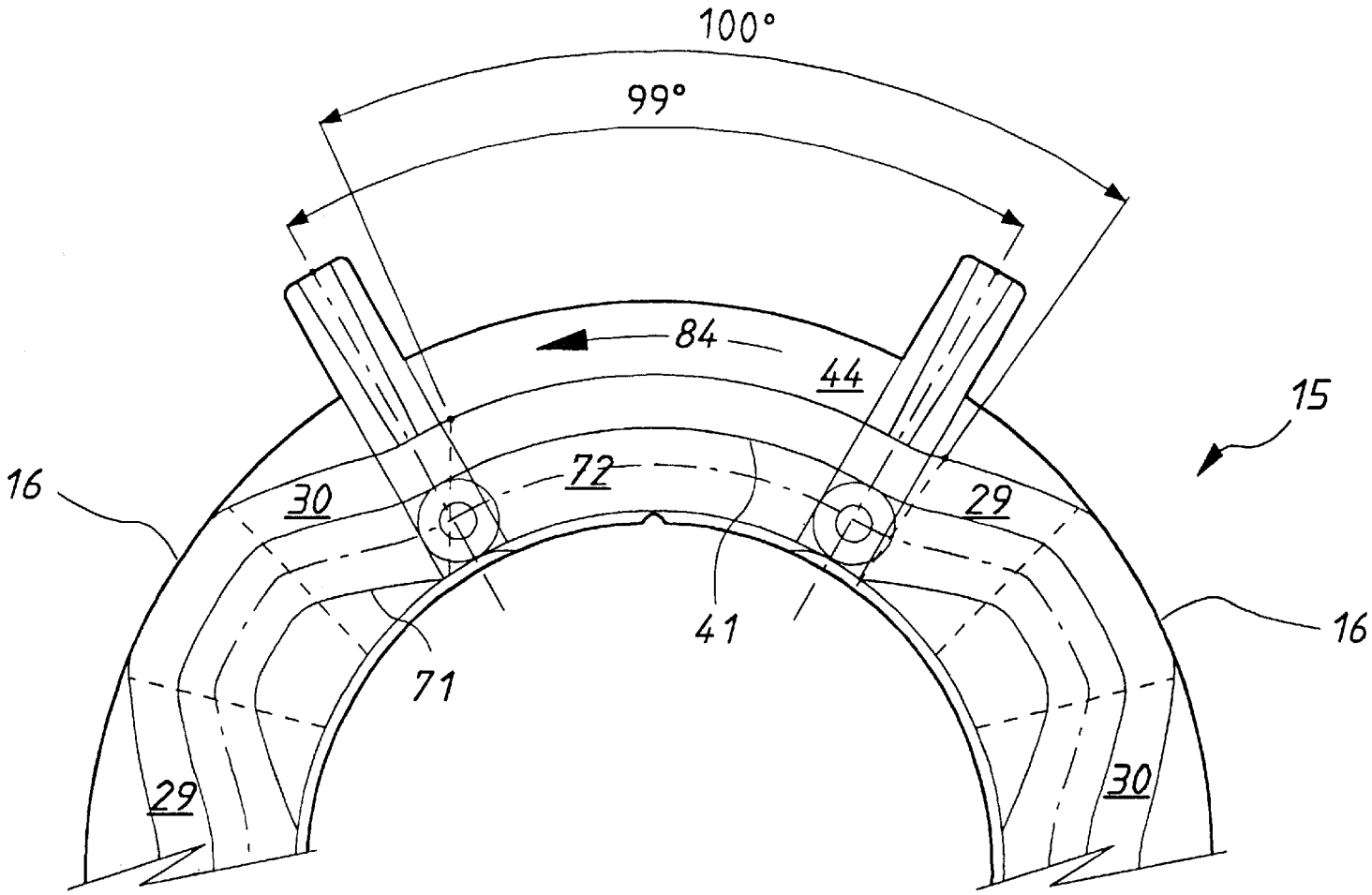
FIG. 29 is a schematic enlarged side elevation of portion of the stator of the motor of FIG. 13.

It is further preferred that the angle 100 between adjacent passages 29 and 30 of each cavity 44 is greater than the angle 99 between two adjacent gates 35. As is best seen from FIG. 29, the angle 100 is greater than the angle 99.

Figure 30:
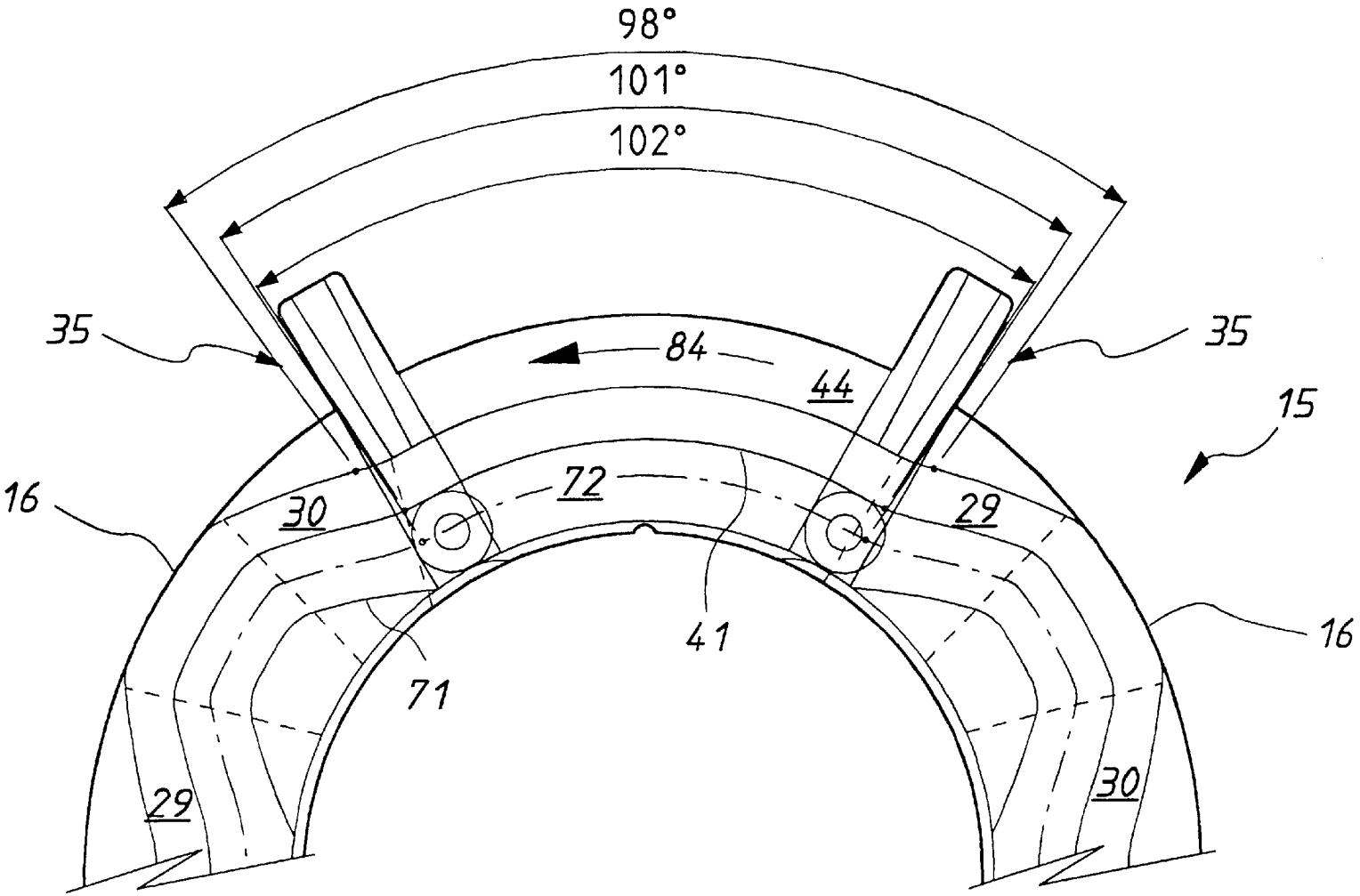
FIG. 30 is a further stator side elevation.

With reference to FIG. 30, the angle between rise and fall portions of adjacent lobes 16 (angle 98) is greater than the corresponding angle 101 of the cam track 72. In turn, the angle 101 is greater than the angle 102 (the angle extending between points on the surface 41 at which the surface 41 is at a transition between a constant radius and a radius defined by the lobes 16). The angle 102 is greater than the angle 99.

It should further be appreciated that the transition points of the radial outer surface of the stator 15 are not radially aligned with the transition points of the surface 41. The transition points being defined where each of the surfaces changes in radius.

This non alignment of transition points of various surfaces would facilitate smoother operation of the rollers-gate assembly with minimum mechanical and hydraulic loads or friction losses as they move from one surface to another surface with different radius of curvature.

Figure 31:
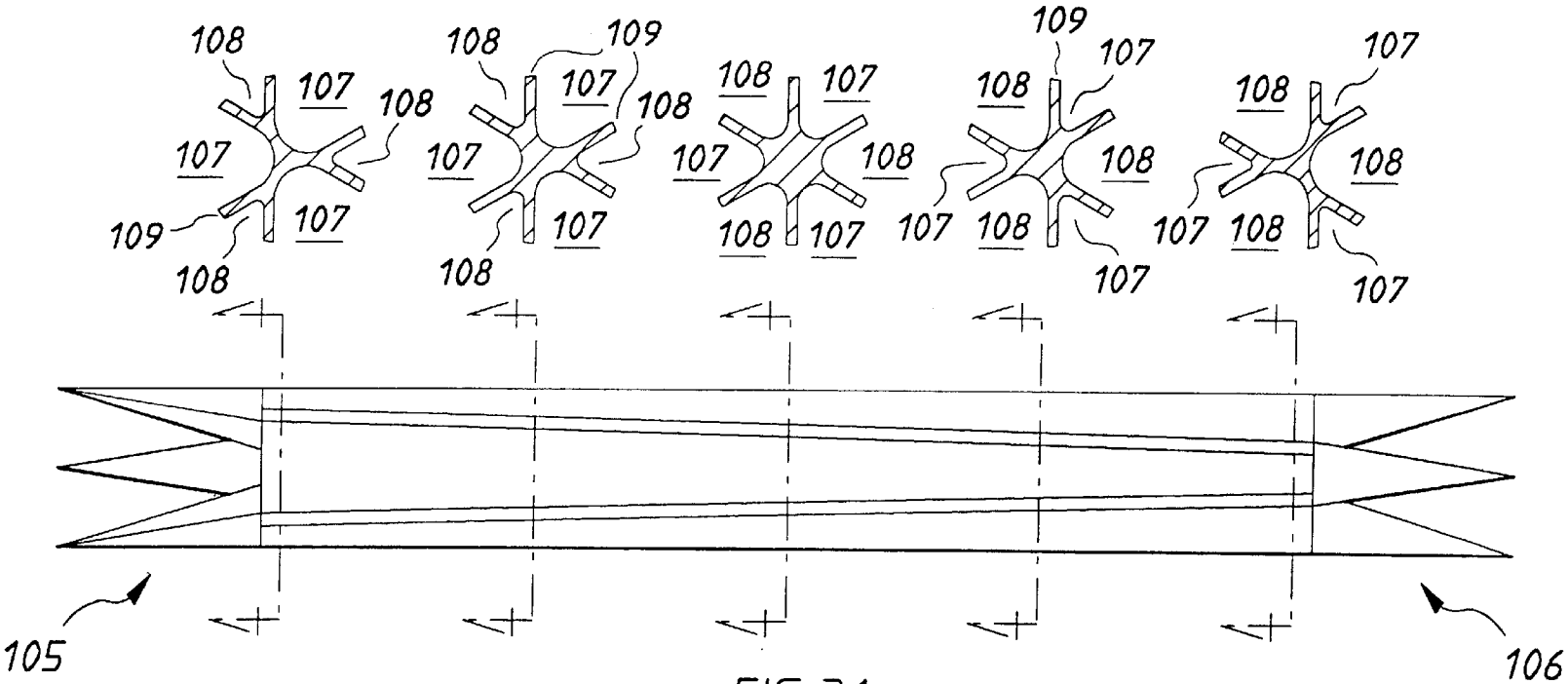
FIG. 31 is a schematic side elevation an alternative flow divider to that employed in the machine of FIG. 3, together with cross sections therethrough.
Figure 32:
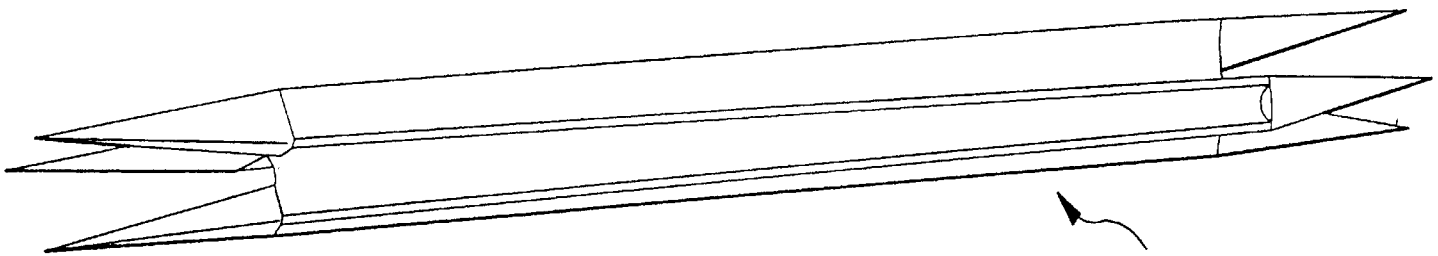
FIG. 32 is a schematic perspective view of the flow divider of FIG. 31.
Figure 33:
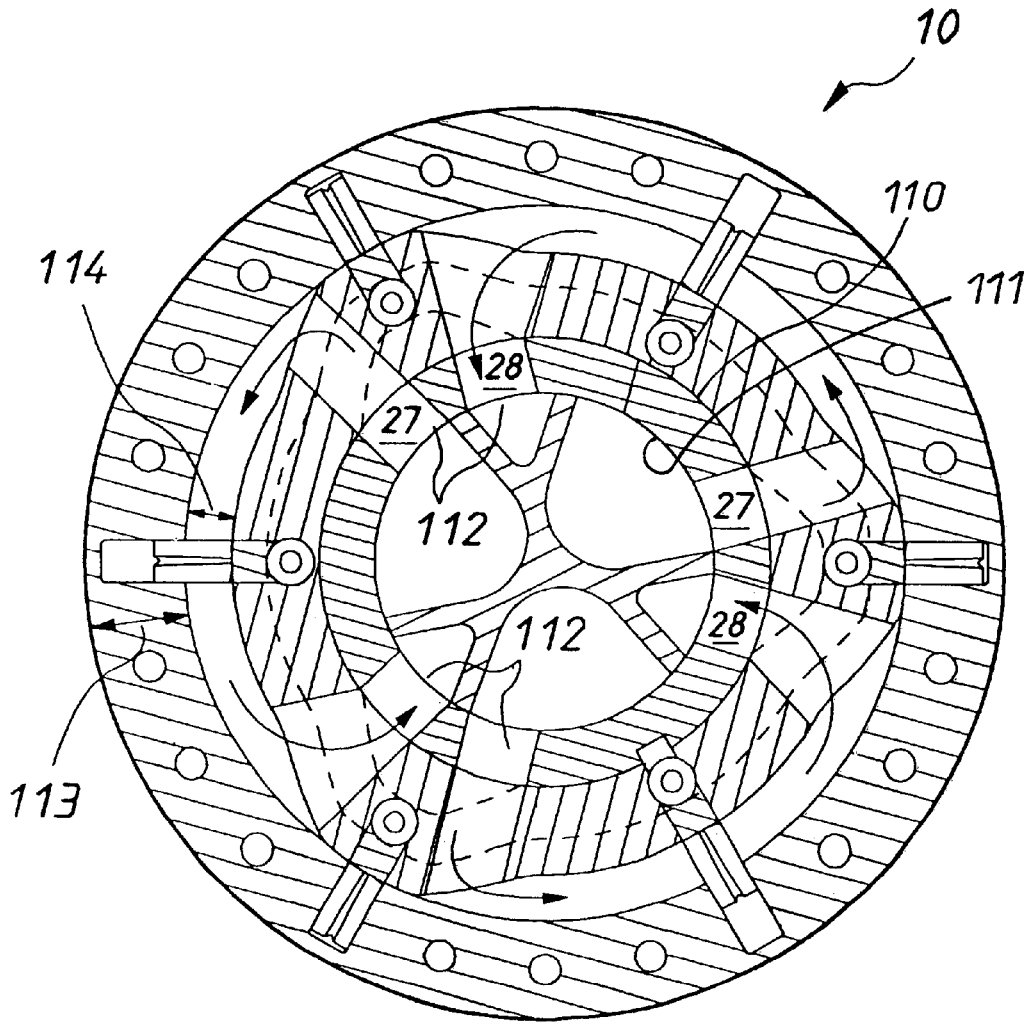
FIG. 33 is a schematic sectioned side elevation of the motor of FIG. 3 with the flow divider of FIGS. 31 and 32.

In FIGS. 31 to 33 of the accompanying drawings there is schematically depicted an alternative construction for the duct defining member 23 and flow divider 31. In this embodiment a manifold member 104 is intended to replace the duct member 32 and flow divider 31. The manifold member 104 has an inlet end 105 and an outlet end 106. Extending from the inlet end 105 are inlet passages 107, while outlet passages 108 extend to the outlet end 106. The passages 107 and 108 are separated by vanes 109. The inlet passages 107 decrease in transverse cross sectional area from the end 105 to the end 106 while converse occurs in respect of the outlet passages 108. Accordingly there are parallel and coextensive inlet and outlet flows. Within the said shaft-manifold assembly unit, it supplies flows to each of the multi-stacked machines 10 from inlet passages 107 and simultaneously receives flows from the said machines to outlet passages 108.

In the above described preferred embodiments, preferably the machine 10 is constructed so as to meet the following criteria.

$$D_m < D\{1-(2P\times10^{-7})/(ND^3)\}^{0.25}$$

where

P=power rating of the machine (Watts)

N=speed rating of the machine (rev/min)

D=shaft 14 outside diameter (m) 110

DM=shaft 14 inside diameter 111

$$W_p/D < 0.75$$

where

D=shaft 14 outside diameter (m) 110 and $W_p$112 =Σ(inlet passage width 27+outlet passage width 28)

$$W_t\mathbf{113} > 1.2L\ \mathbf{114}$$

where $W_t$=wall thickness of outer housing 11

L=lift of stator (height of lobes 16)

The above mentioned dimensions are indicated in FIG. 33.

What is claimed is:

1. A rotary machine through which a working fluid passes, said machine including at least:

a central shaft means having a radially outer peripheral surface provided with at least one lobe having a maximum radius relative to a longitudinal axis of the shaft means, said central shaft means having a longitudinally extending fluid inlet passage and fluid outlet passage at axially opposite ends thereof; said inlet passage extending to a plurality of inlet passage portions and said outlet passage extending from a plurality of outlet passage portions which are longitudinally co-extensive with said inlet passage portions;

an outer housing having an inner cylindrical surface surrounding the central shaft means, the inner surface having a radius approximately equal to said maximum radius; bearing means extending between the housing and central shaft means to provide for relative rotation therebetween;

a plurality of gates movably mounted in the housing for movement between a retracted position at least substantially located in said housing and an extended position protruding from said housing;

said gates, central shaft means and housing co-operating to define at least two variable volume working chambers, the volumes of which change with relative rotation between the shaft means and housing about said axis;

first duct means extending through said central shaft means between said inlet passage portions and said chambers at a position adjacent to said lobe on a first angular side thereof;

second duct means extending through said central shaft means between said outlet passage portions and said chambers adjacent to said lobe on the other angular side thereof to the first duct means;

wherein relative rotation between said central shaft means and housing provides for movement of said working fluid through said chambers via said first and second duct means.

2. A rotary machine of claim 1, wherein said central shaft means includes a shaft and a stator coaxially mounted thereon, said stator providing said at least one lobe, with the duct means extending through the shaft and stator.

3. The rotary machine of claim 2, further including a longitudinally extending duct defining member disposed within said shaft and in which said inlet passage portions and outlet passage portions are formed.

4. The rotary machine of claim 3, further including a flow diverter disposed in said inlet passage for substantially evenly dividing a flow of working fluid at said fluid inlet passage and directing said working fluid to said inlet passage portions.

5. The rotary machine of claim 4, wherein said flow diverter includes one or more radially extending vanes for dividing said fluid inlet passage into a plurality of portions.

6. A motor assembly including a plurality of motors, each motor being a rotary machine according to claim 2, with the rotary machines having a common shaft means so that the shaft of each rotary machine is provided by a common shaft, the common shaft providing a plurality of inlet passages and outlet passages which are longitudinally coextensive.

7. The motor assembly of claim 6, further including a manifold member mounted internally of said shaft and dividing said shaft axially internally so as to provide said inlet and outlet passages.

8. The rotary machine of claim 1, wherein said rotary machine is a motor, with said central shaft means consisting of a shaft and a stator mounted thereon, said stator providing each lobe, said shaft having an outer diameter and an inner diameter according to the following formula:

$$D_m < D\{1-(2P\times10^{-7})/(ND^3)\}^{.025}$$

where

P=power rating of the machine (Watts)

N=speed rating of the machine (rev/min)

D=shaft outside diameter (m)

Dm=shaft inside diameter.

9. The machine of claim 8, wherein said first and second duct means include inlet and outlet passages extending between the inside and outside diameter of the shaft, and wherein the shaft is configured such that:

$$W_p/D<0.75$$

where

D=shaft outside diameter (m) and $W_p=\Sigma$, (inlet passage width+outlet passage width).

10. The rotary machine according to claim 1, wherein said outer housing has a wall thickness, and each lobe has a radial lobe height, with the wall thickness being such that:

$$W_t>1.2L$$

where $W_t$=wall thickness of outer housing

L=lift of stator (height of lobes) where $W_t$ is the wall thickness and L is the radial height of each lobe.

11. The rotary machine of claim 1, wherein said central shaft means includes a stator portion providing said at least one lobe and having a radially outer surface, and each gate has a radially inner surface adjacent the radially outer surface of the stator, and a radially outer surface, with each gate further including a passage extending between the gate radially inner and radially outer surfaces.

12. The rotary machine of claim 11, wherein the gate passages extend from a leading or a trailing portion of the radially inner surface of the gate.

13. The rotary machine of claim 1, wherein said central shaft means includes a stator providing said at least one lobe, and the gates are of a "yoke" configuration so as to provide a base from which there radially inwardly extends a pair of generally parallel transversely spaced coextensive stator legs, and the stator includes cam means operatively associated with the stator legs to cause radial movement of the gates in coordination with movement of the gate relative to the lobes.

14. The rotary machine of claim 13, wherein each stator leg is provided with a rotatable bearing means operatively associated with the cam means to cause radial movement of the gates.

15. The rotary machine of claim 13, further including gate engaging means fixed to or forming part of the housing and engaging the gates to aid in maintaining close tolerances between the base of the gates and the stator.

16. The rotary machine of claim 13, wherein said stator has a radially outer peripheral surface providing said at least one lobe, with said outer peripheral surface providing rise and fall surfaces for said lobes and a surface of generally constant radius, with the rise and fall surfaces being joined to the surface of constant radius by transition areas, and wherein said cam means has corresponding transition areas which are not radially aligned with the transition areas of the peripheral surface of the stator.

17. The rotary machine of claim 16, wherein the transition areas of said stator peripheral surface between adjacent lobes are angularly spaced by an angle greater than the angle of the corresponding transition areas of said cam means are spaced.

18. A motor assembly including a plurality of motors, each motor being a rotary machine according to claim 1, and wherein the motors are arranged so that the gates of adjacent motors are not longitudinally aligned and/or the lobes of adjacent motors are not longitudinally aligned.

19. The rotary machine of claim 6, further including a flow divider operatively associated with said manifold member so that the working fluid passing through each inlet passage has substantially the same flow rate and pressure, and said outlet passages extend to a common outlet passage.

20. The rotary machine of claim 19, wherein the inlet passages decrease longitudinally in transverse cross section as the outlet passages increase in transverse cross section to provide substantially equal flow and pressure in the inlet passages and substantially equal flow and pressure in the outlet passages.

21. The rotary machine of claim 20, wherein the inlet and outlet passages are at least axially partly coextensive, and are substantially parallel.

22. A rotary machine through which a working fluid passes, said machine including at least:

a central shaft means having a radially outer peripheral surface provided with at least one lobe having a maximum radius relative to a longitudinal axis of the shaft means, said central shaft means having a longitudinally extending bore defining a fluid inlet passage and fluid outlet passage at axially opposite ends thereof;

a duct defining member disposed in said bore which, together with a surface of said bore, defines a plurality of inlet passage portions and outlet passage portions, said inlet passage portions being longitudinally co-extensive with said outlet passage portions, and where said inlet passage extends to said plurality of inlet passage portions and said outlet passage extends from said plurality of outlet passage portions;

an outer housing having an inner cylindrical surface surrounding the central shaft means, the inner surface having a radius approximately equal to said maximum radius; bearing means extending between the housing and central shaft means to provide for relative rotation therebetween;

a plurality of gates movably mounted in the housing for movement between a retracted position at least substantially located in said housing-and an extended position protruding from said housing;

said gates, central shaft means and housing co-operating to define at least two variable volume working chambers, the volumes of which change with relative rotation between the shaft means and housing about said axis;

first duct means extending through said central shaft means between said inlet passage portions and said chambers at a position adjacent to said lobe on a first angular side thereof, second duct means extending through said central shaft means between said outlet passage portions and said chambers adjacent said lobe on the other angular side thereof to the first duct means;

wherein relative rotation between said central shaft means and housing provides for movement of said working fluid through said chambers via said first and second duct means.

23. The rotary machine of claim 22, wherein said central shaft means includes a shaft containing said bore and a stator coaxially mounted thereon, said stator providing said at least one lobe, with said first and second duct means extending through the shaft and stator.

24. The rotary machine of claim 23 further including a flow diverter disposed in said inlet passage for substantially evenly dividing a flow of working fluid at said fluid inlet passage and directing said working fluid to said inlet passage portions.

25. The rotary machine of claim 23, wherein said flow diverter includes one or more radially extending vanes for dividing said fluid inlet passage into a plurality of portions.

26. A motor assembly including a plurality of motors, each motor being a rotary machine according to claim 23, with the rotary machines having a common shaft means so that the shaft of each rotary machine is provided by a common shaft, the common shaft providing a plurality of inlet passages and outlet passages which are longitudinally coextensive.

27. The motor assembly of claim 26 further including a manifold member mounted internally of said shaft and dividing said shaft axially internally so as to provide said inlet and outlet passages.

28. The rotary machine of claim 22 wherein said rotary machine is a motor, with said central shaft means consisting of a shaft and a stator mounted thereon, said stator providing each lobe, said shaft having an outer diameter and an inner diameter according to the following formula:

$$D_m < D\{1-(2P\times10^{-7})/(ND^3)\}^{025}$$

where

P=power rating of the machine (Watts)

N=speed rating of the machine (rev/min)

D=shaft outside diameter (m)

Dm=shaft inside diameter.

29. The machine of claim 28, wherein said first and second duct means include inlet and outlet passages extending between the inside and outside diameter of the shaft, and wherein the shaft is configured such that:

$$W_p/D<0.75$$

where

D=shaft outside diameter (m) and $W_p=\Sigma$, (inlet passage width+outlet passage width).

30. The rotary machine according to claim 22, wherein said outer housing has a wall thickness, and each lobe has a radial lobe height, with the wall thickness being such that:

$$W_t>1.2L$$

where $W_t$=wall thickness of outer housing

L=lift of stator (height of lobes) where $W_t$ is the wall thickness and L is the radial height of each lobe.

31. The rotary machine of claim 22, wherein said central shaft means includes a stator portion providing said at least one lobe and having a radially outer surface, and each gate has a radially inner surface adjacent the radially outer surface of the stator, and a radially outer surface, with each gate further including a passage extending between the gate radially inner and radially outer surfaces.

32. The rotary machine of claim 31, wherein the gate passages extend from a leading or a trailing portion of the radially inner surface of the gate.

33. The rotary machine of claim 22, wherein said central shaft means includes a stator providing said at least one lobe, and the gates are of a "yoke" configuration so as to provide a base from which there radially inwardly extends a pair of generally parallel transversely spaced coextensive stator legs, and the stator includes cam means operatively associated with the stator legs to cause radial movement of the gates in coordination with movement of the gate relative to the lobes.

34. The rotary machine of claim 33, wherein each stator leg is provided with a rotatable bearing means operatively associated with the cam means to cause radial movement of the gates.

35. The rotary machine of claim 33, further including gate engaging means fixed to or forming part of the housing and engaging the gates to aid in maintaining close tolerances between the base of the gates and the stator.

36. The rotary machine of claim 33, wherein said stator has a radially outer peripheral surface providing said at least one lobe, with said outer peripheral surface providing rise and fall surfaces for said lobes and a surface of generally constant radius, with the rise and fall surfaces being joined to the surface of constant radius by transition areas, and wherein said cam means has corresponding transition areas which are not radially aligned with the transition areas of the peripheral surface of the stator.

37. The rotary machine of claim 36, wherein the transition areas of said stator peripheral surface between adjacent lobes are angularly spaced by an angle greater than the angle of the corresponding transition areas of said cam means are spaced.

38. A motor assembly including a plurality of motors, each motor being a rotary machine according to claim 22, and wherein the motors are arranged so that the gates of adjacent motors are not longitudinally aligned and/or the lobes of adjacent motors are not longitudinally aligned.

39. The rotary machine of claim 26, further including a flow divider operatively associated with said manifold member so that the working fluid passing through each inlet passage has substantially the same flow rate and pressure, and said outlet passages extend to a common outlet passage.

40. The rotary machine of claim 39, wherein the inlet passages decrease longitudinally in transverse cross section as the outlet passages increase in transverse cross section to provide substantially equal flow and pressure in the inlet passages and substantially equal flow and pressure in the outlet passages.

41. The rotary machine of claim 40, wherein the inlet and outlet passages are at least axially partly coextensive, and are substantially parallel.

* * * * *